United States Patent [19]

Armas

[11] 4,088,296

[45] May 9, 1978

[54] APPARATUS FOR MOLDING THE INTERIOR OF BUILDING MODULES

[76] Inventor: Eduardo Santana Armas, G.P.O. 3806, San Juan, P.R. 00936

[21] Appl. No.: 736,845

[22] Filed: Oct. 29, 1976

Related U.S. Application Data

[63] Continuation-in-part of Ser. No. 594,035, Jul. 8, 1975, abandoned, which is a continuation-in-part of Ser. No. 544,418, Jan. 7, 1975, Pat. No. 4,019,293.

[51] Int. Cl.[2] ..... B28B 7/30

[52] U.S. Cl. ..... 249/180; 249/27; 249/152; 249/184

[58] Field of Search ..... 249/26, 27, 152, 178, 249/180–182, 184, 186

[56] References Cited

U.S. PATENT DOCUMENTS

| | | | |
|---|---|---|---|
| 2,524,981 | 10/1950 | Tourneau | 249/181 |
| 2,827,683 | 3/1958 | Benart et al. | 249/180 |
| 3,205,552 | 9/1965 | Johnson et al. | 249/152 |
| 3,558,095 | 1/1971 | McNiel | 249/27 |
| 3,614,054 | 10/1971 | Beasly | 249/27 |
| 3,814,374 | 6/1974 | Beemer et al. | 249/152 |
| 3,934,808 | 1/1976 | Aizawa | 249/152 |

*Primary Examiner*—Francis S. Husar
*Assistant Examiner*—John McQuade
*Attorney, Agent, or Firm*—Kenneth P. Synnestvedt

[57] ABSTRACT

Apparatus and method for molding generally cubical building modules of concrete, the apparatus comprising both internal and external movably mounted molding components and preferably including mechanisms for advancing the components into molding position and for withdrawing the components from the molding position upon completion of the molding of a module. The method involves the use of such molding components and contemplates certain sequences in the advancement and withdrawal of the molding components for different portions of the modules.

19 Claims, 38 Drawing Figures

Fig.3.
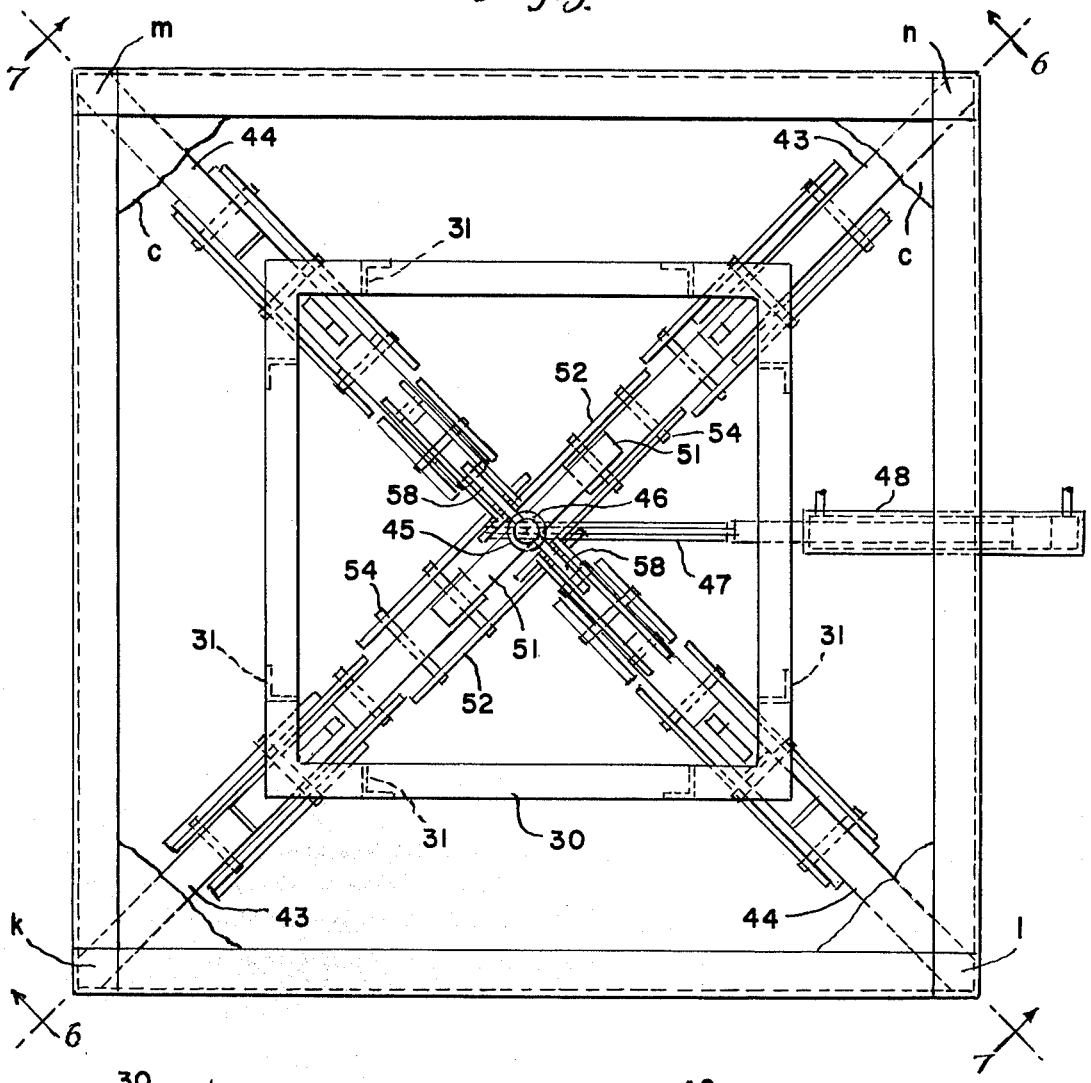
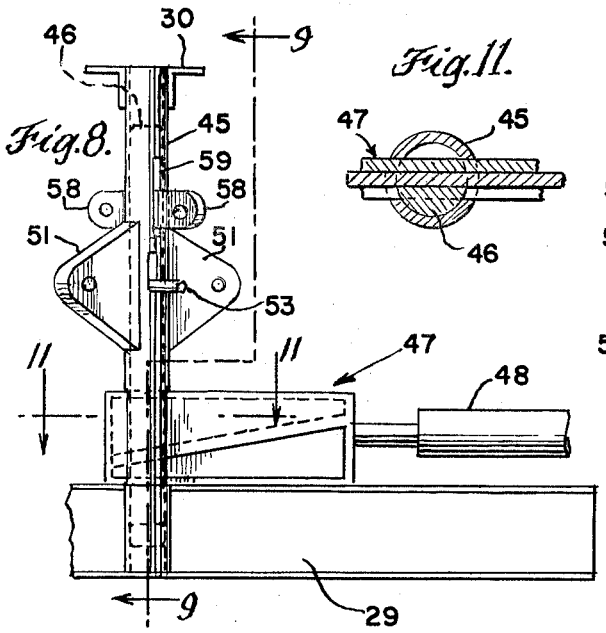
Fig.8.
Fig.11.
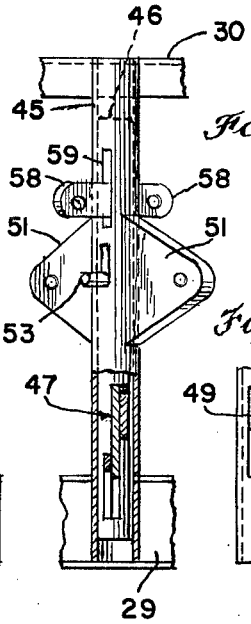
Fig.9.
Fig.10A
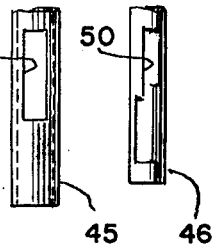
Fig.10.

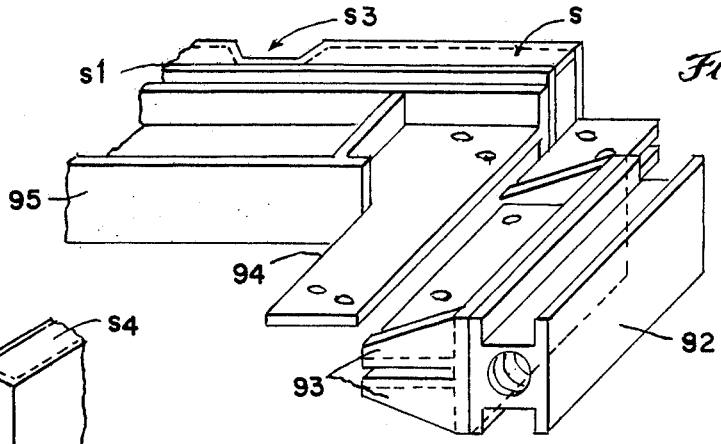
Fig. 15.
Fig. 16.
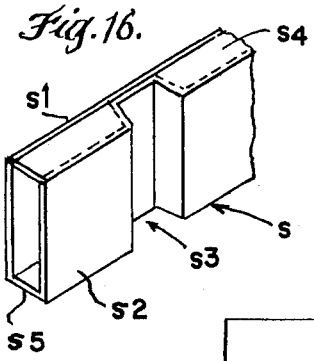
Fig. 17.
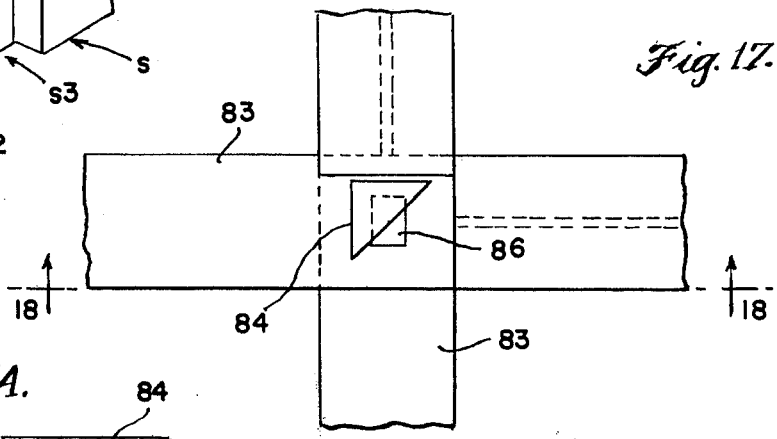
Fig. 17A.
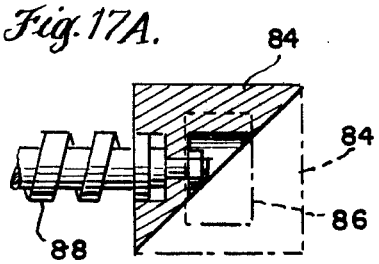
Fig. 18.
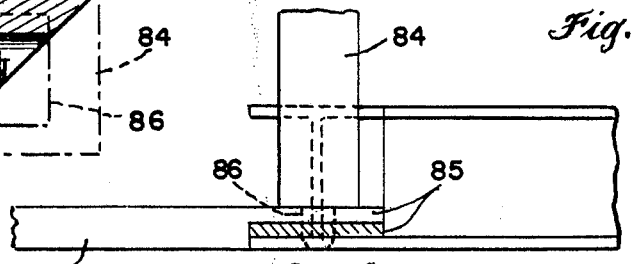
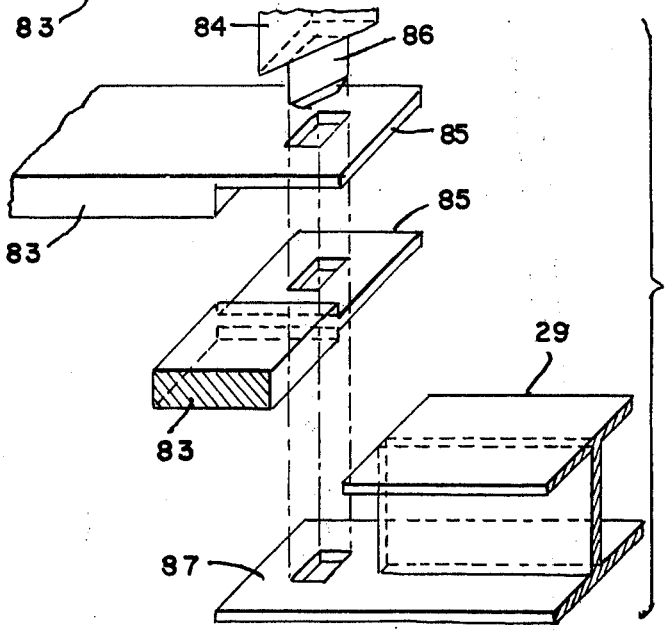
Fig. 19.

Fig. 20. PLAN VIEW, ROD 44 FULLY EXTENDED TO POSITION #0
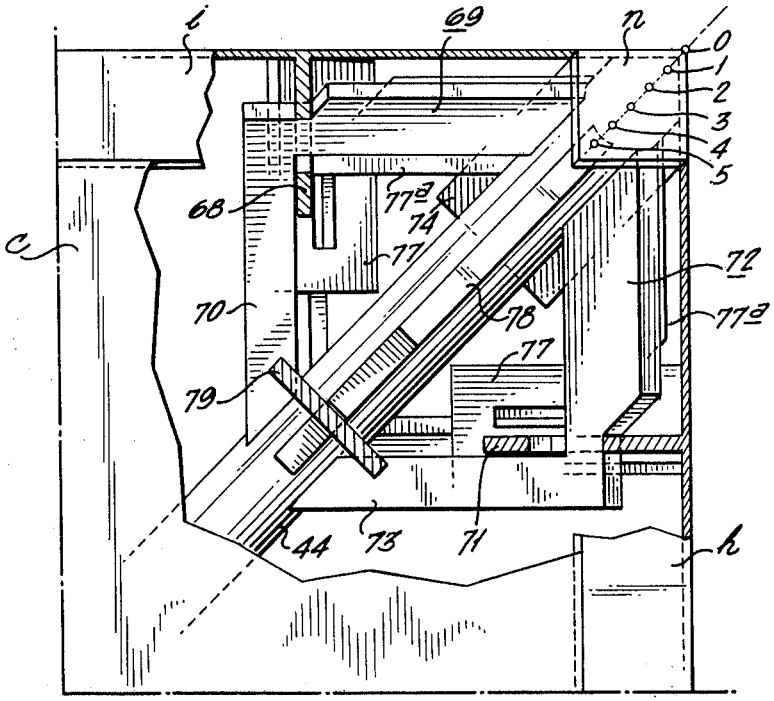
Fig. 21. PLAN VIEW, ROD 44 FULLY RETRACTED TO POSITION #5
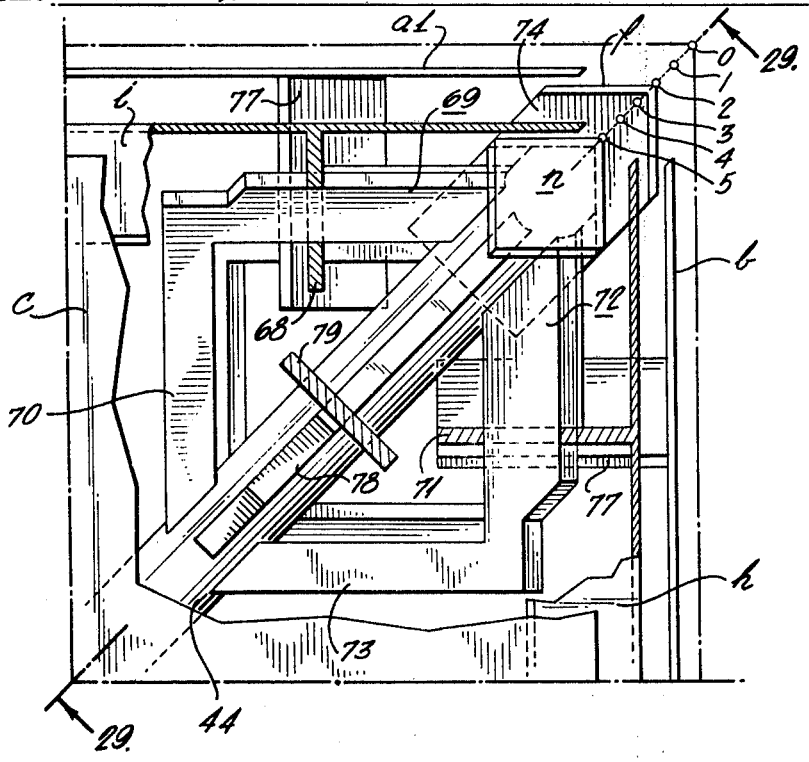

Fig. 22. PLAN VIEW, ROD 44 RETRACTED TO POSITION #1
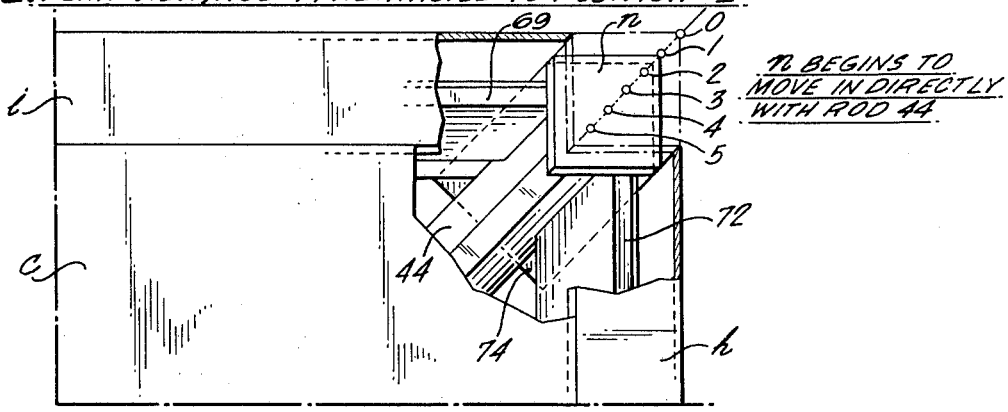
Fig. 23. PLAN VIEW, ROD 44 RETRACTED TO POSITION #1
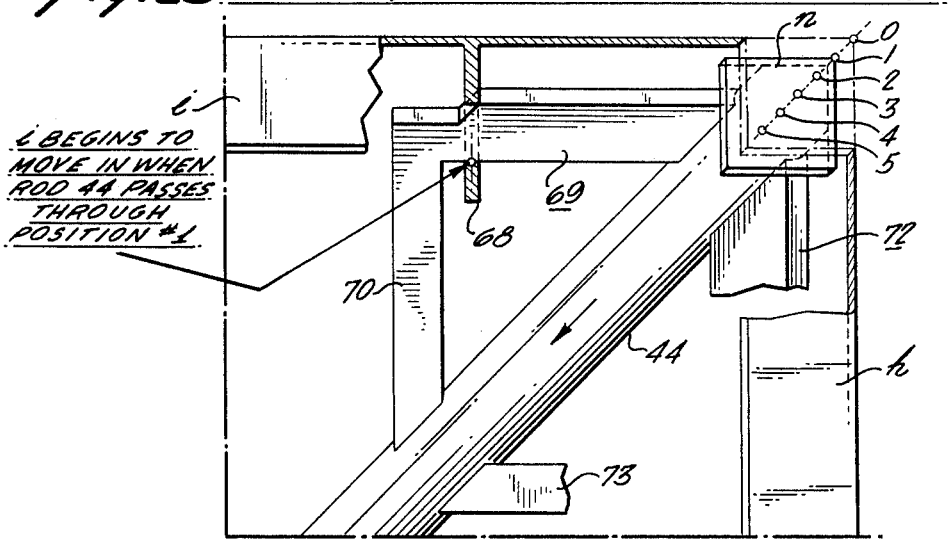
Fig. 24. PLAN VIEW, ROD 44 RETRACTED TO POSITION #2
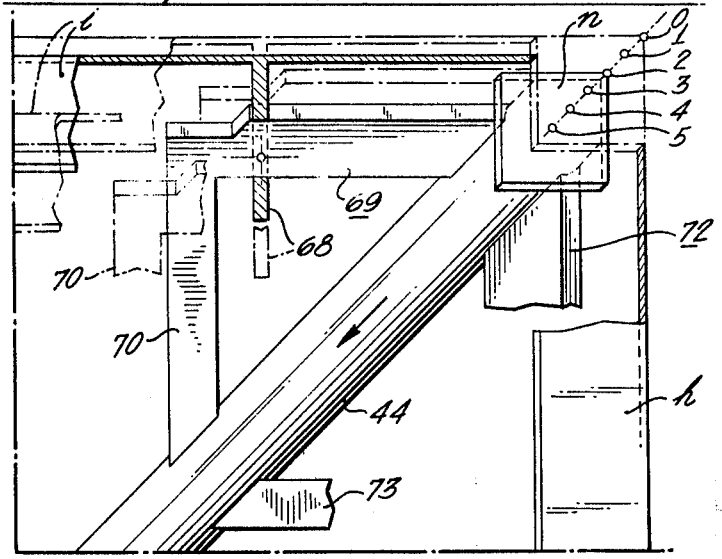

Fig. 25. PLAN VIEW, ROD 44 RETRACTED TO POSITION #2
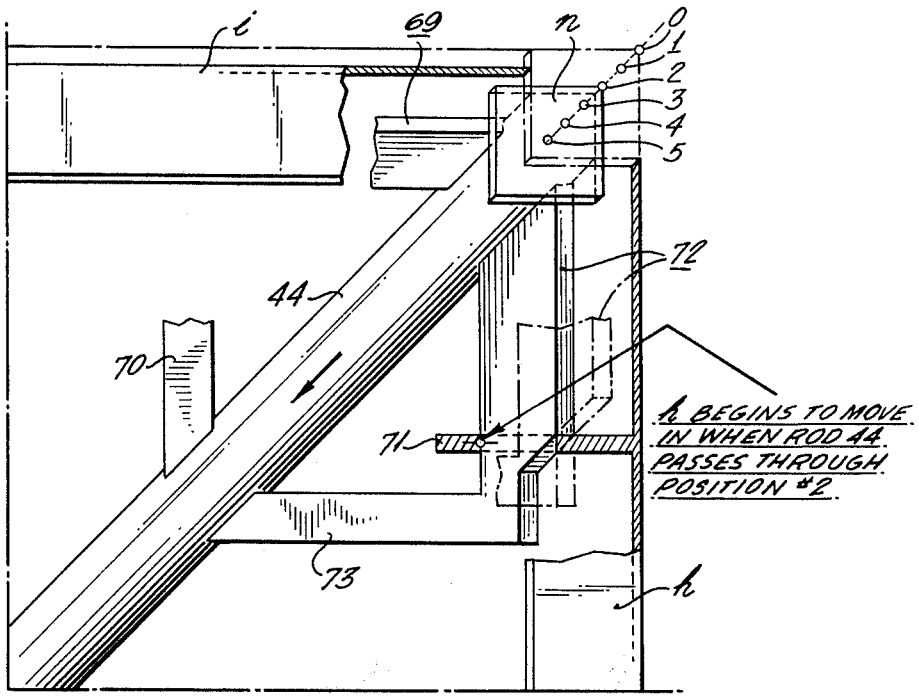
Fig. 26. PLAN VIEW, ROD 44 RETRACTED TO POSITION #3
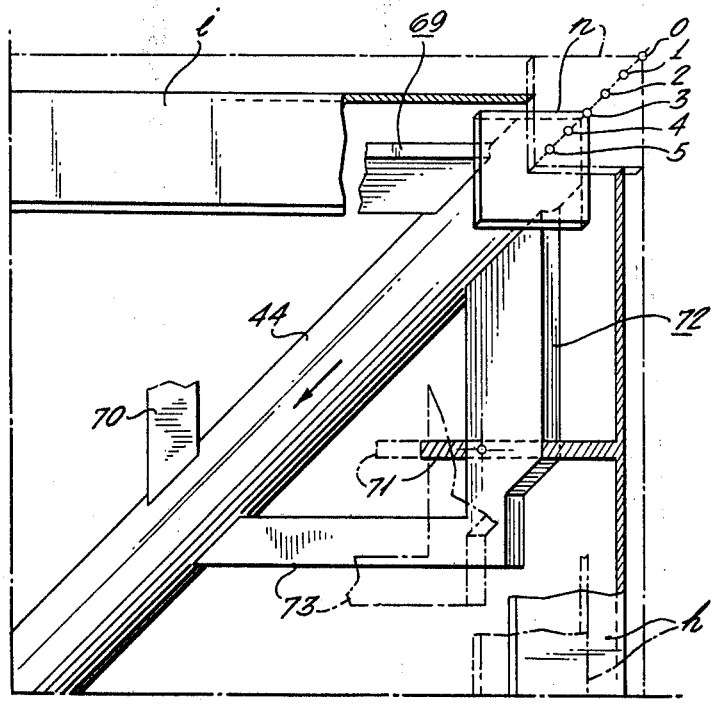

Fig. 27. PLAN VIEW, ROD 44 FULLY EXTENDED, POSITION #0
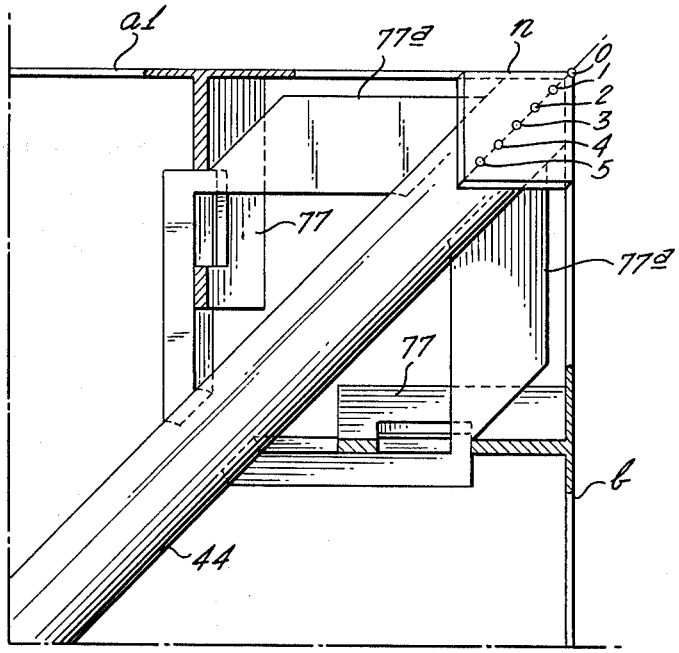
Fig. 28. PLAN VIEW, ROD 44 RETRACTED TO POSITION #4
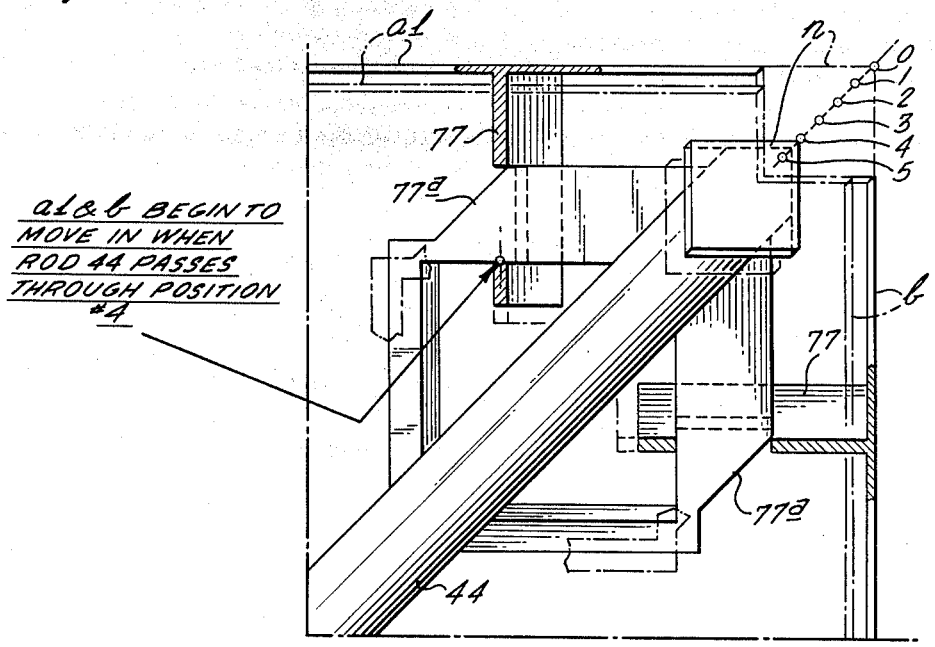

Fig. 29. SECTIONAL ELEVATION, LINE 29, 29 FIG. 21 ROD 44 IN POSITION #5
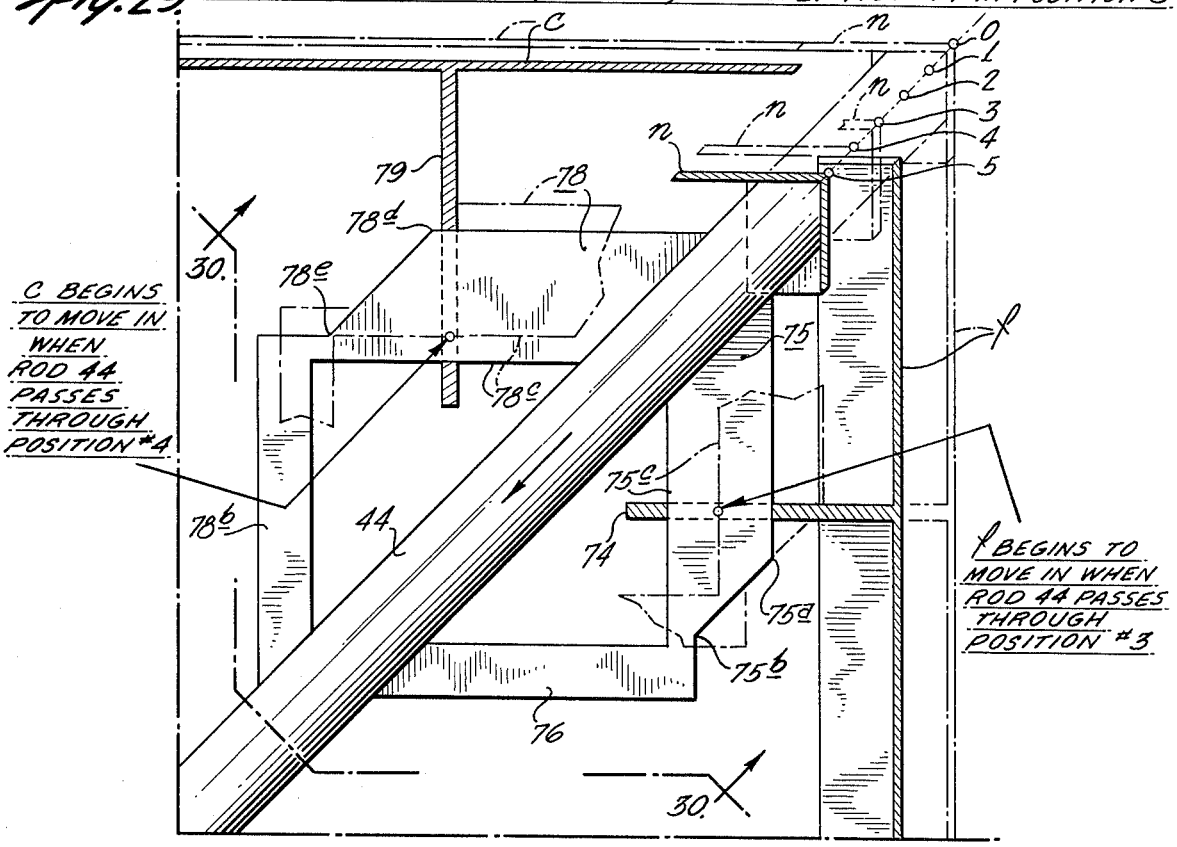
Fig. 30. SECTIONAL VIEW, LINE 30, 30 FIG. 29, ROD 44 IN POSITION #0
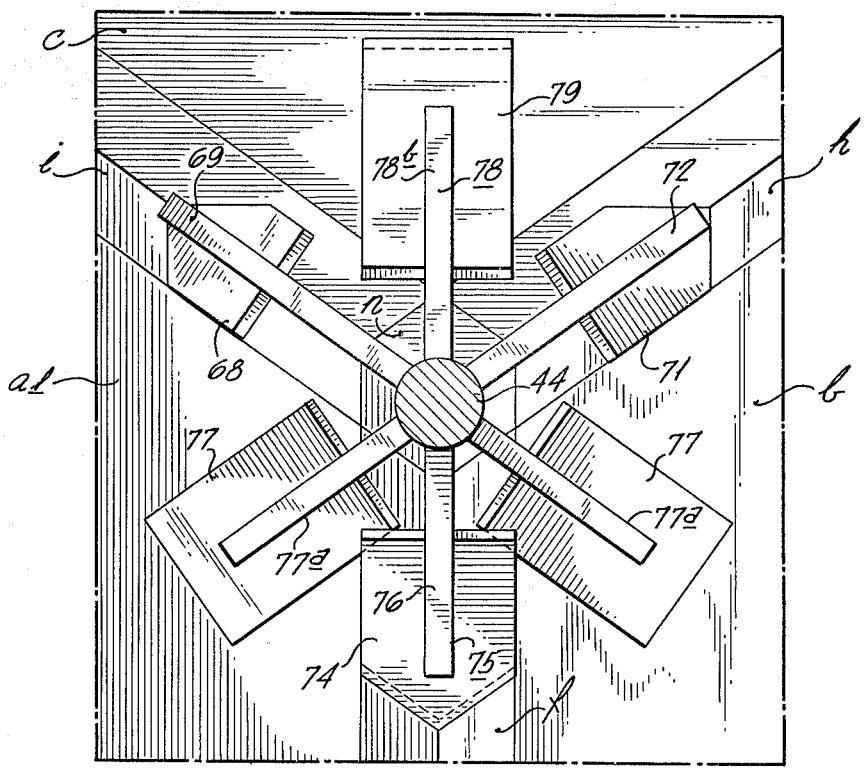

Fig. 31. PLAN VIEW, ROD 61 FULLY EXTENDED, TO POSITION #0
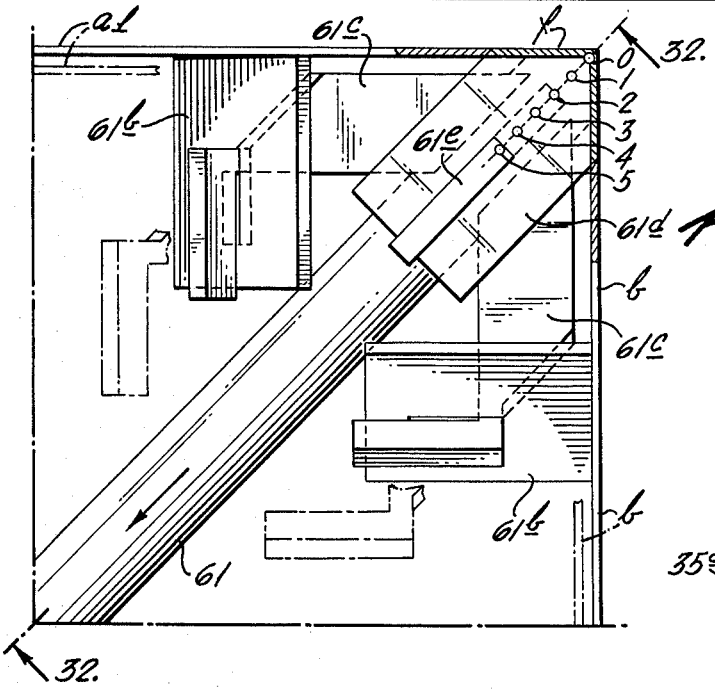
Fig. 33.
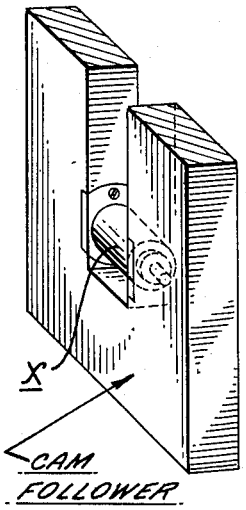
Fig. 5a.
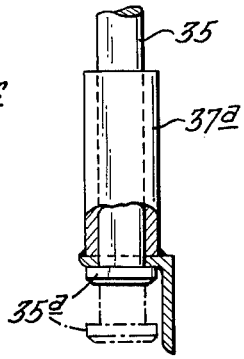
Fig. 32.
SECTIONAL ELEVATION, ROD 61 FULLY EXTENDED, POSITION #0
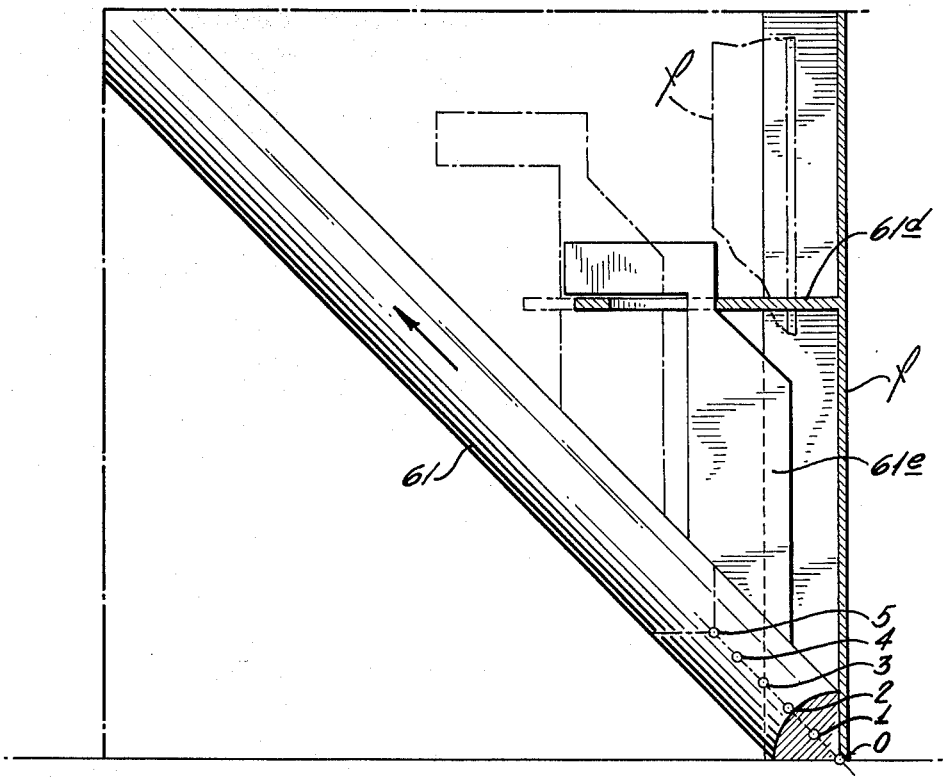

APPARATUS FOR MOLDING THE INTERIOR OF BUILDING MODULES

CROSS REFERENCE

The present application is a Continuation-in-Part of my prior application Ser. No. 594,035, filed July 8, 1975, now abandoned which in turn is a Continuation-in-Part of application Ser. No. 544,418, filed Jan. 7, 1975, issued Apr. 26, 1977 as U.S. Pat. No. 4,019,293, which latter application discloses generally cubical building modules of a type particularly adapted to be produced by the method and apparatus disclosed herein.

Although the present application and my prior application Ser. No. 594,035 disclose many features of equipment for molding both the internal and external surfaces of the modules, as well as features of a method for operating the molding equipment, the present application is directed to features of the equipment for molding the internal surfaces of the modules.

BACKGROUND AND STATEMENT OF OBJECTS

It is contemplated according to the present invention that generally cubical building modules be substantially completely fabricated or premolded in a manufacturing plant and be distributed or delivered from the manufacturing plant to the building cite, as by truck delivery.

It is a major objective of the present invention to provide apparatus which is adapted to mass produce the modules, with a minimum of individual or separate manual attention to the modules being fabricated.

A further general objective of the invention is to provide for such mass production of the building modules, while, at the same time, making possible some variations in the specific structure of individual modules fabricated, as, for instance, provision for doors and/or windows variously distributed in the walls of the modules.

The arrangement disclosed also provides separately operatable internal mold parts and external mold parts, together with molding framing and interconnection means between the framing for the internal mold parts and the framing for the external mold parts, in order to provide accurate interpositioning of the internal and external mold parts.

Another objective of the invention is to provide internal mold parts subdivided into a plurality of components which are so configured and arranged that they may be sequentially advanced into and withdrawn from molding position without interference with each other, which has heretofore presented problems requiring virtually total disassembly and reassembly of the components when molding each individual module.

Although it is contemplated that at least the internal molding parts may be manually advanced or withdrawn from the molding position, it is also an objective of the present invention to provide equipment for automatically effecting such movements of the mold parts and for automatically imposing a predetermined sequence of advancing and withdrawing movements of the mold parts.

BRIEF DESCRIPTION OF DRAWINGS

Numerous other objectives and advantages of the apparatus of the present invention will appear more fully from the following description referring to the accompanying drawings in which:

FIG. 3 is an enlarged plan view of the internal mold parts, and of mounting framing and operating mechanisms therefore, the mold sheet for the top wall of the cubical being mostly broken out or removed in order to disclose parts lying within the internal mold equipment;

Figure 2:
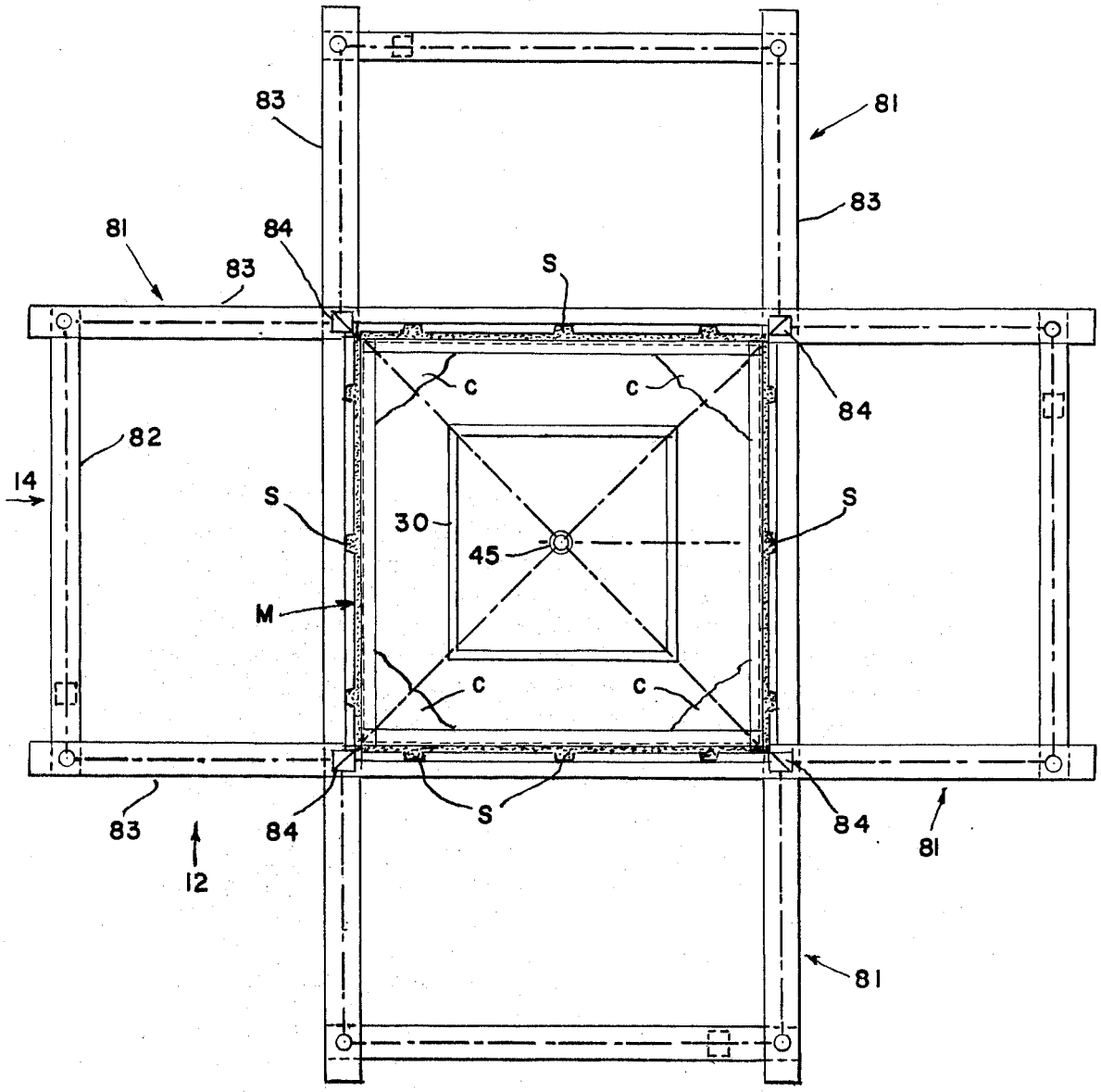
FIG. 2 is an outline top plan view of various of the internal and external mold parts and supporting frames, showing an assembly of four outside mold supporting frames for the side walls of a cubical and the relationship thereof to the inside molding apparatus.
Figure 6:
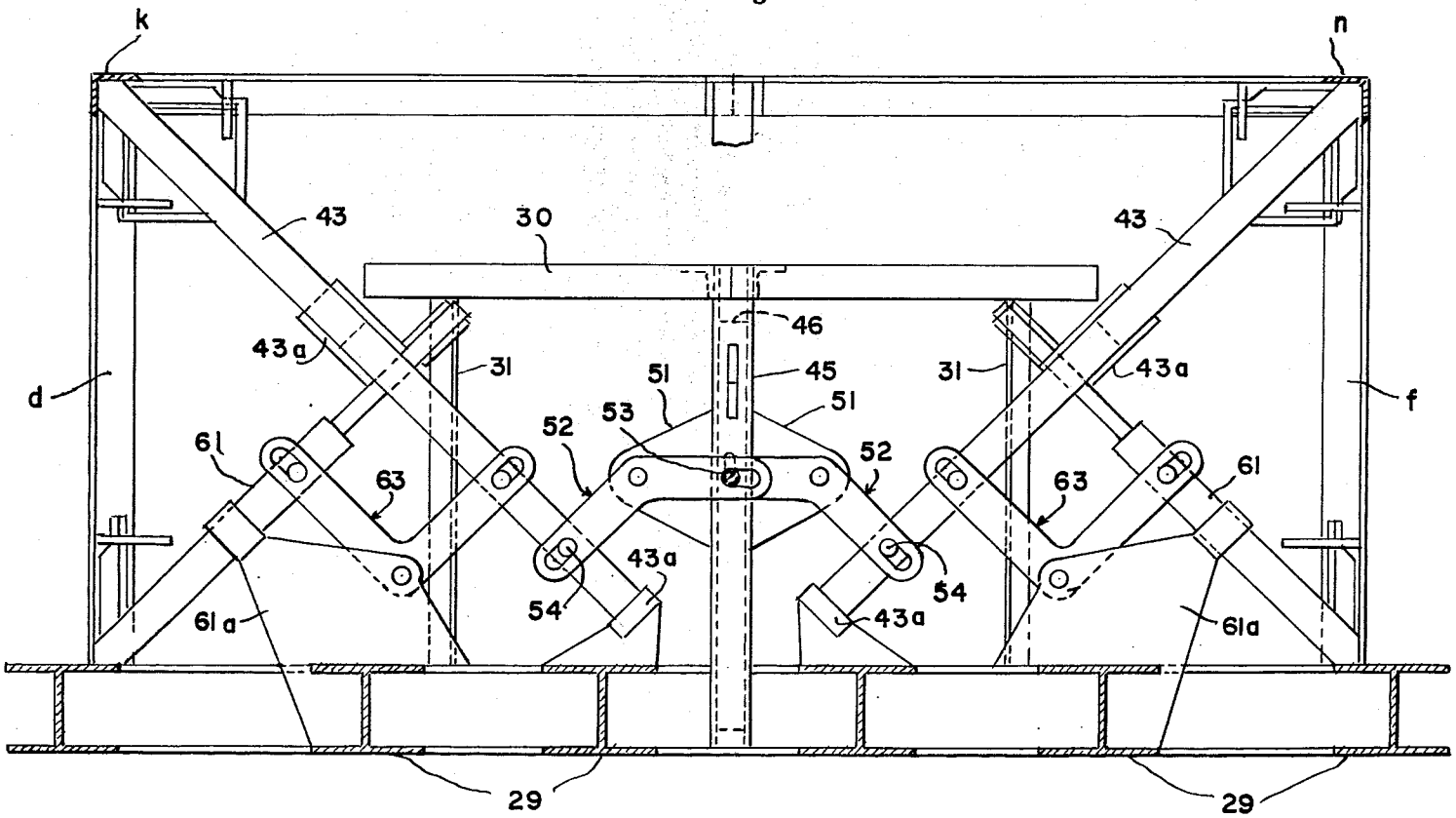
Figure 7:
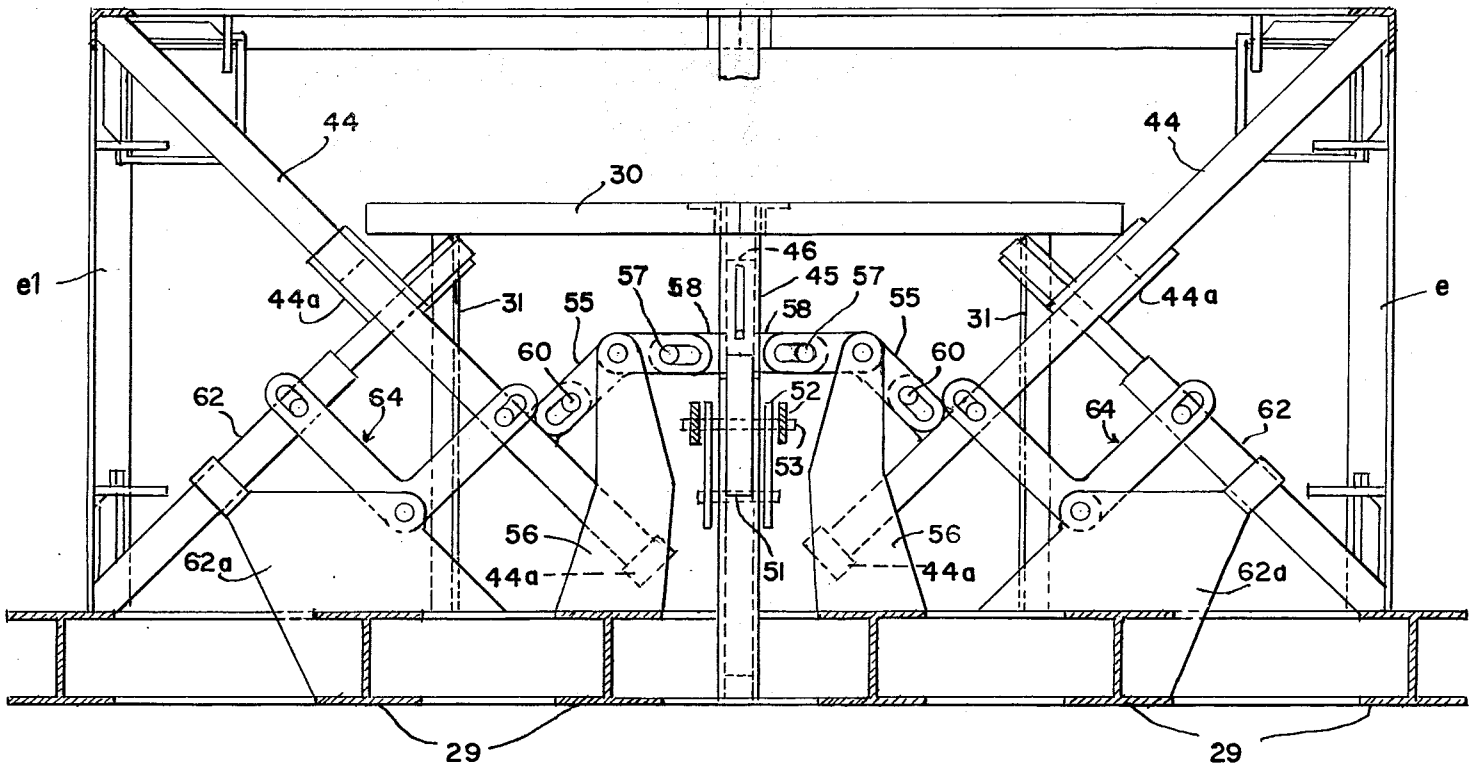
Figure 12:
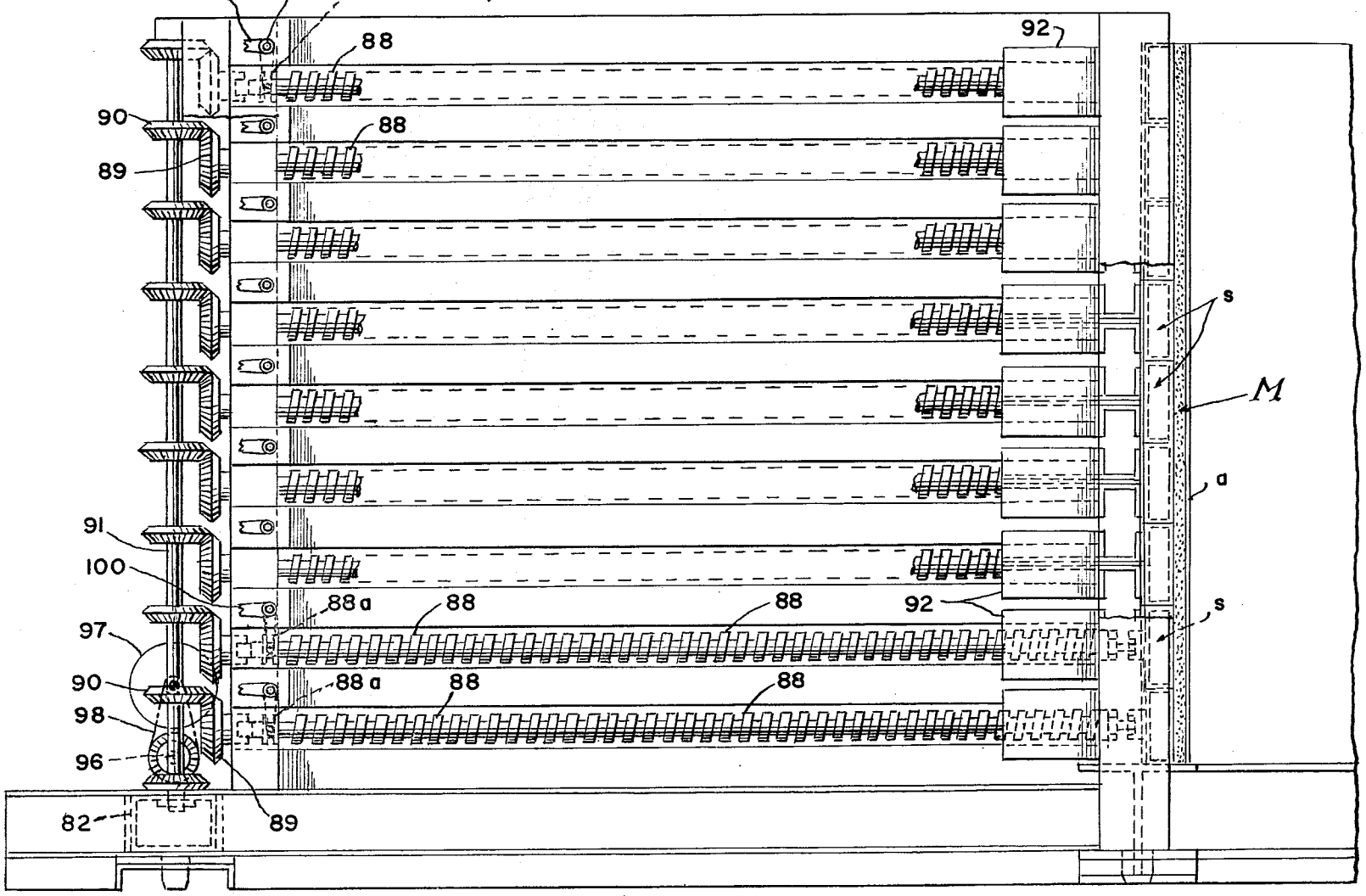
Figure 13:
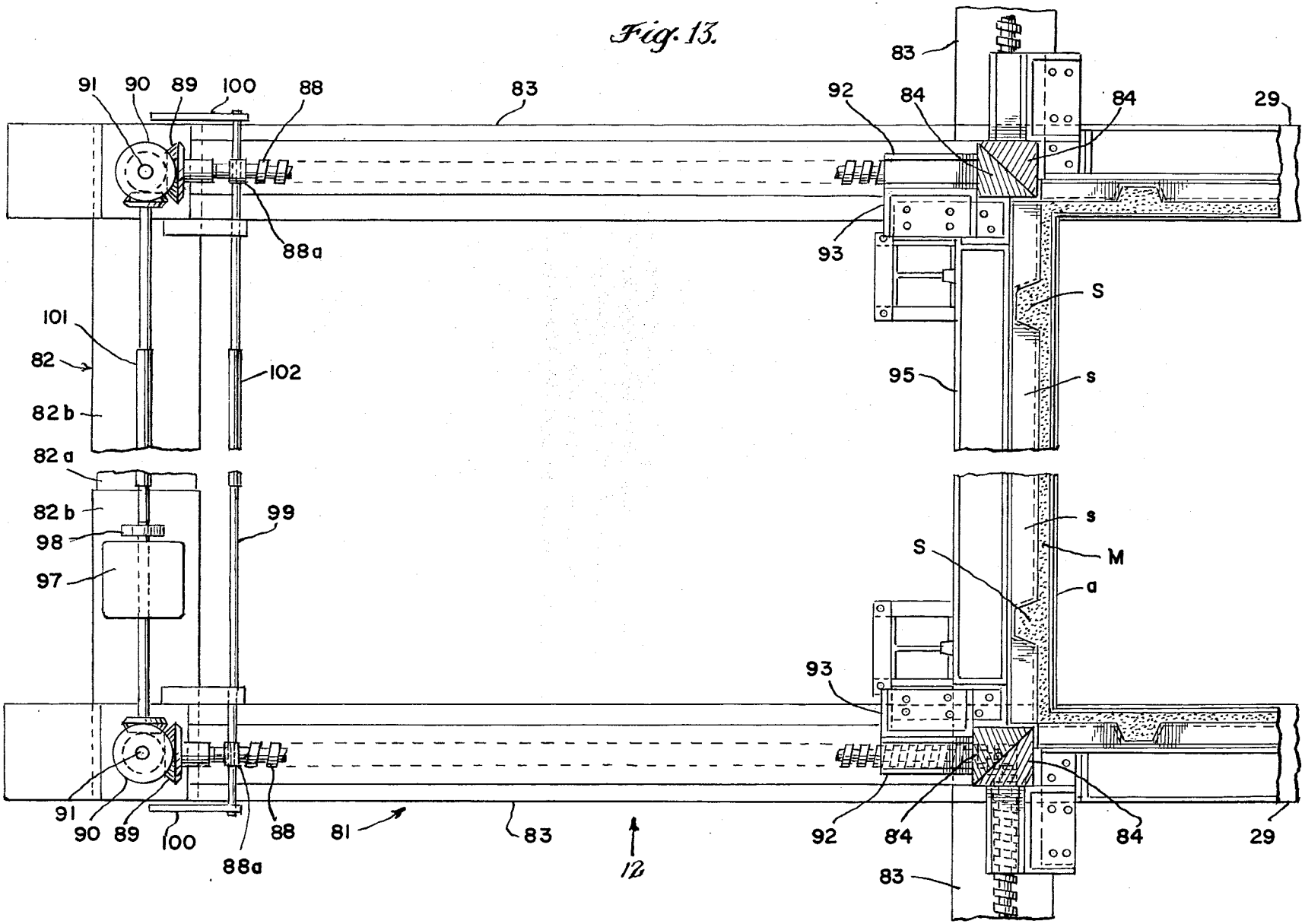
Figure 14:
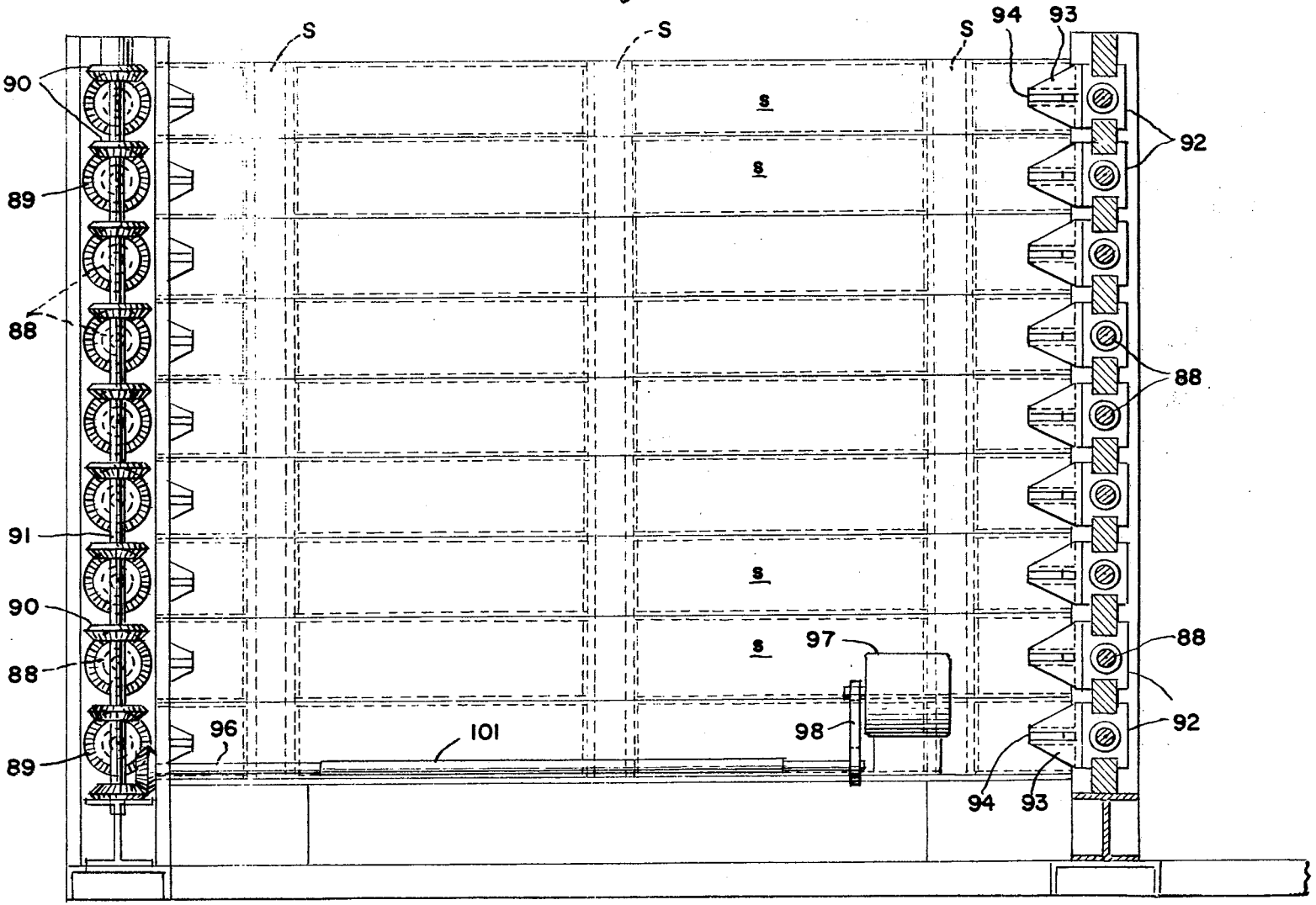

FIG. **5*a* is a fragmentary detail view of a motion limiting stop useable with equipment of the kind shown in FIGS. 4 and 5** as will be explained;

FIG. 6 is a diagonal vertical sectional view, taken generally as indicated by the line 6—6 on FIG. 3, but showing various of the internal operating parts in elevation;

FIG. 7 is a diagonal vertical sectional view, taken generally as indicated by the line 7—7 on FIG. 3, but showing various of the internal operating parts in elevation; FIG. 8 is a fragmentary elevational view of certain of the internal mold operating parts;

FIG. 9 is a elevational view, partly in vertical section, taken generally as indicated by the line 9—9 on FIG. 8;

FIGS. 10 and 10A are fragmentary elevational views of certain operating parts to be explained hereinafter;

FIG. 11 is a horizontal sectional view taken as indicated by the line 11—11 on FIG. 8;

FIG. 12 is an elevational view of an assembly of parts making up the equipment which may be used for molding the outside surface of one of the side walls of the module, FIG. 12 being taken as indicated by the arrow 12 applied to FIG. 2 and also to FIG. 13;

FIG. 13 is a plan view with certain parts shown in horizontal section, this view illustrating portions of one of the outside assemblies of mold parts shown in FIG. 12;

FIG. 14 is a view taken generally as indicated by the arrow 14 in FIG. 2 but with certain parts shown in section;

FIG. 15 is an exploded isometric view of certain of the framing and mold mounting parts positioned externally of one of the corners of the molding station for a cubical module;

FIG. 16 is a fragmentary isometric view of a portion of one of the mold strips employed in defining the outside wall of the mold cavity for a side wall of a module;

FIG. 17 is a fragmentary plan view of some of the framing parts for mounting the molding components;

FIG. 17A is an enlarged fragmentary horizontal sectional view of certain parts shown in FIG. 17 and also showing an associated lead screw device such as also shown in FIG. 12;

FIG. 18 is a fragmentary elevational view, taken generally as indicated by the line 18—18 on FIG. 17;

FIG. 19 is a vertically exploded view of some of the framing parts and the manner of separably connecting them at a position just outside of a corner of a molding station for a module being formed;

FIGS. 20 to 32 inclusive are fragmentary views, most of which are in plan with parts shown in section, these views illustrating mechanism for effecting the motions of the internal mold parts between the molding position and a retracted position, and showing the manner in which the mechanism for moving the internal mold parts establishes a preferred sequence of withdrawal of the molding components from the molding position, as will be explained more fully hereinafter; and FIG. 33 is a fragmentary sectional view illustrating a cam follower device which may be employed with the equipment provided for retraction of the internal molding parts from the molding position and for return of the internal molding parts into the molding position.

GENERAL DESCRIPTION OF MOLDING COMPONENTS

In considering the drawings, it is first pointed out that the parts which define the inner surfaces of the wall or walls of the cubical module being formed are subdivided into a number of mold components and also that the mold parts which define the outside of the wall mold cavity are likewise subdivided into a plurality of mold components, but the manner of subdivision of the internal mold components is different from the manner of subdivision of the external mold components for reasons to be explained.

Figure 1B:
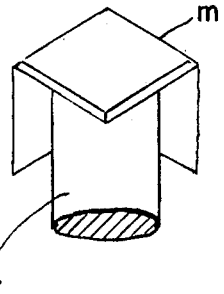
FIG. 1B is an enlarged view of a molding component used at an upper corner of the internal molding parts, and indicating the manner of mounting of such corner components.
Figure 1:
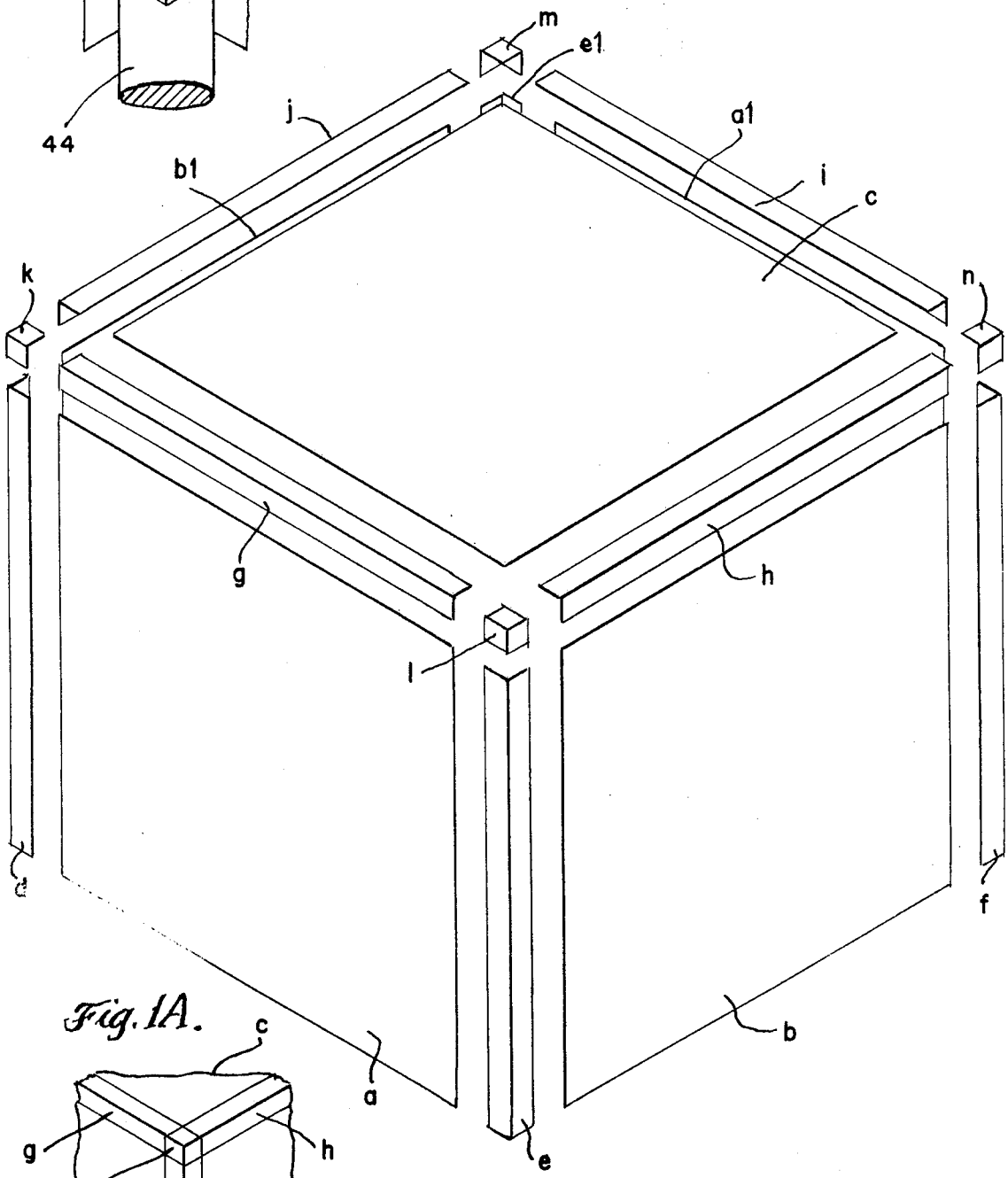
FIG. 1 is a diagrammatic view of the internal mold parts or components, the view being in the nature of an exploded view, the parts being shown only in single line outline for simplicity of illustration.

The manner of subdivision of the internal mold components is diagrammatically indicated in the exploded view of FIG. 1. Thus, the internal components include four upright wall molding sheets such as the two wall sheets which appear at *a* and *b* on the near sides of the assembly shown in FIG. 1, the upper edges of the other two wall sheets appearing at *a*1 and *b*1. The top or roof sheet appears at *c*. There are also four upright edge pieces, in the form of 90° angle strips, such as those indicated at *d, e, f* and *e*, which intervene between the adjacent edges of the sheets *a, b* etc. Four horizontal edge pieces *g, h, i* and *j*, also in the form of 90° angle strips are provided at the edges of the top sheet *c*, which respectively intervene between an edge of the top sheet and the upper edge of one of the wall sheets *a, b* etc. Finally, corner pieces *k, l, m* and *n* are arranged at the upper corners of the module, all of these components being shown in somewhat separated or exploded relationship in FIG. 1.

Figure 1A:
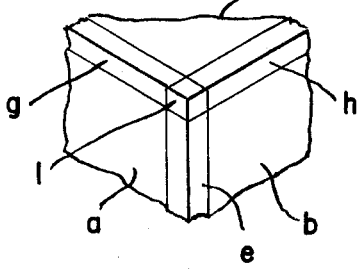
FIG. 1A is a fragmentary view of one upper corner portion of the mold components, but with the parts shown assembled in molding position, instead of exploded as in FIG. 1.

When the internal mold components are positioned in normal (unexploded) relationship, they fit together in a manner to define the entirety of the internal surface of the cubical module being molded. The fragmentary FIG. 1A illustrates one of the upper corners of the assembly when the components are assembled in their normal molding positions.

Although in FIG. 1 these mold components are shown in single line outline only, it is here pointed out that as will be described hereinafter, especially with reference to FIGS. 20–32 inclusive, the edges of these various internal mold components are bevelled or angled in a manner not only providing a substantially unbroken molding surface within the interior of the module being formed, but also to provide for withdrawal of the molding components inwardly from molding position in a certain preferred sequence, as will be described.

Before describing the mounting of the internal mold components, attention is directed to FIGS. 12, 13, 14 and 16 illustrating the mold strips which are employed as the components which define the outside surfaces of the mold cavity for the module being formed. As has been mentioned, each outside wall is defined by a series of horizontally elongated mold strips *s* which are positioned in superimposed edge-to-edge relation as shown in FIG. 12 (see also FIG. 16) and each of which is made up of a flat outside strip or plate *s*1 and an inside strip or plate *s*2 which is, in effect, vertically corrugated as indicated at *s*3 in order to provide for the molding of reinforcing ribs or studs on the outside surface of the wall of the module being formed. These horizontal mold components also preferably have both top and bottom wall elements *s*4 and *s*5 serving to close the hollow spaces between the inside and outside walls *s*1 and *s*2 of the mold strip.

From examination of FIGS. 2, 12 and 13, it will be seen that a module M is shown as being molded of concrete, these figures illustrating one of the upright module walls lying between the internal plate or sheet component *a* and the vertically superimposed series of outside strips *s*. From FIGS. 2 and 13 it will be seen that the channels *s*3 (see also FIG. 16) of the outside wall molding strips *s* serve to define and mold studs or vertical reinforcements S projecting from the outside surface of the module wall.

According to the apparatus provided by the present invention, the internal molding components as described above are mounted for advancement into molding position and for withdrawal from molding position, and the internal and external mold components are provided with means for accurate innerpositioning of the internal and external components, in order to accurately define the desired cavity in which to mold the desired module.

MOUNTING OF INTERNAL MOLD PARTS

In considering the mounting and arrangement of the various molding components attention is first directed to FIGS. 3–11 and 20–33 inclusive which illustrate the internal mold mounting and operating parts.

As best seen in FIGS. 6 and 7, various mold mounting and operating parts are mounted on a main base frame indicated at 29. This frame not only serves to support the internal mold components, but also projects beyond the upright walls of the module being formed and cooperates with the external wall mold frames described hereinafter in order to interposition the internal and external mold parts and thus provide an accurately shaped mold cavity.

Frame structure 30 mounted on the base frame 29 by means of uprights 31, provides support for mechanism adapted to guide the motions of the internal molding components into and out of molding position. Thus, referring particularly to FIGS. 4 and 5, the side wall sheets, such as the sheet shown at *a*, are provided with guide rods 32, these rods being fixed to the interior surface of the upright mold sheets, as by means of sockets 33. The rods 32 project inwardly and are received in tubular or cyclinder guide sleeves 34 which guide sleeves are mounted on the framing 30 and thus provide for guided motion of the upright wall sheets outwardly and inwardly for advancement to and for withdrawal from molding position. It will be understood that each of the upright wall sheets is provided with a plurality, for instance four of such guide rods and guide sleeves as just described.

Similarly the roof molding sheet *c* is provided with guide rods 35 connected with the roof sheet by means of sockets 36 and projecting downwardly to cooperate with tubular guide sleeves 37, which are also carried by the framing 30.

Figure 4:
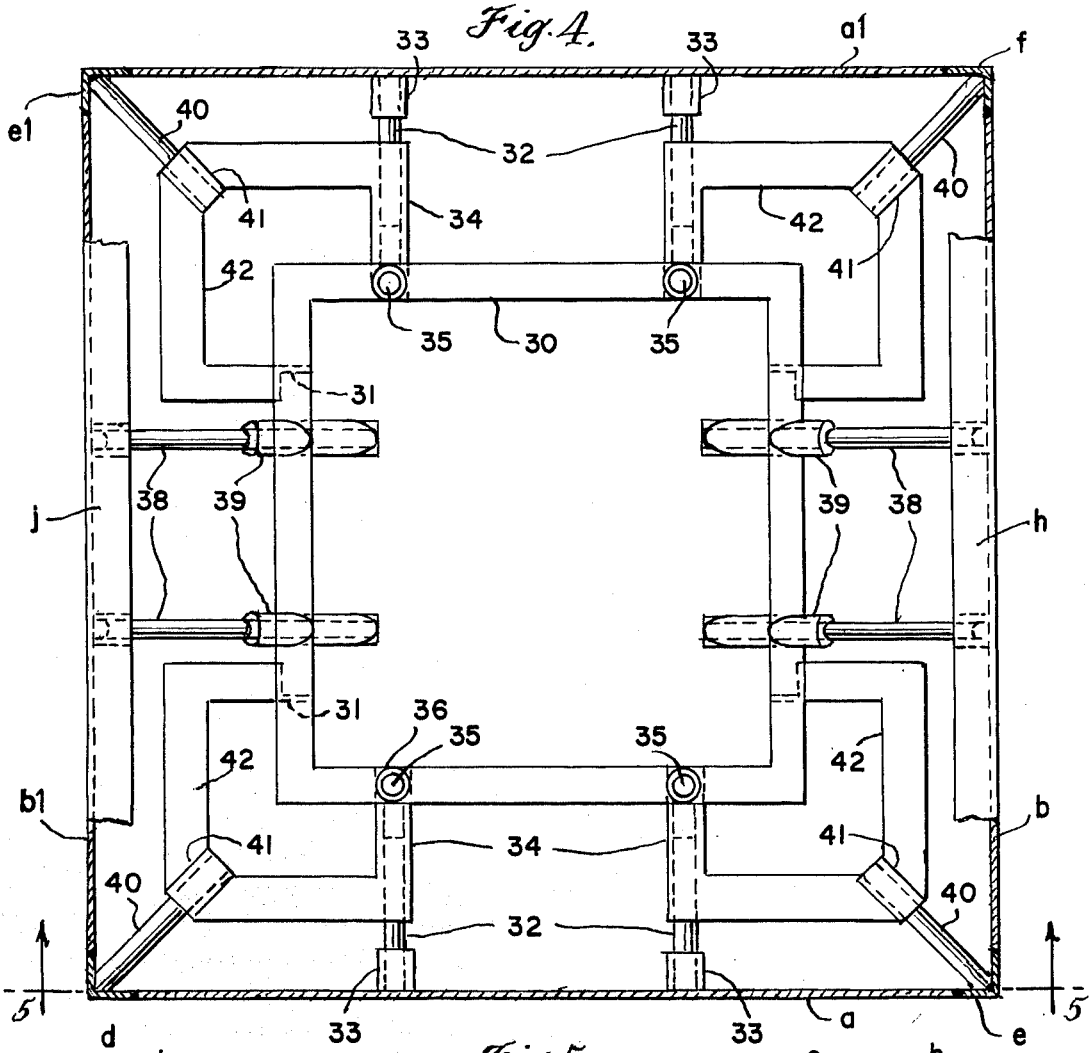
FIG. 4 is a view similar to FIG. 3 but illustrating certain other parts employed for guiding the motions of the internal mold parts, this view being taken as indicated by the line 4—4 on FIG. 5.
Figure 5:
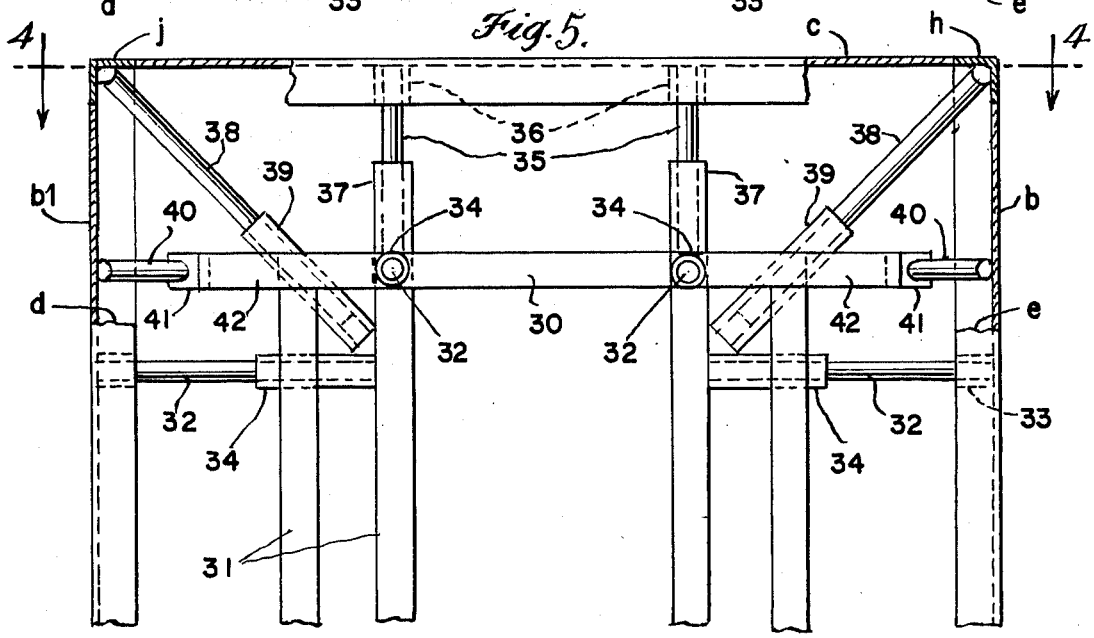
FIG. 5 is a partial elevational view, with portions in vertical section, this view being taken generally as indicated by the line 5—5 on FIG. 4.

Other internal molding components are provided with guiding means and various of these are also shown in FIGS. 4 and 5. Thus, in both FIGS. 4 and 5, the edge components *h* and *j* are each provided with guide rods 38 which are fastened to the edge components and project diagonally downwardly and inwardly for cooperation with the tubular guide sleeves 39 which, again, are mounted upon the framing 30. Although not shown in FIGS. 4 and 5, it will be understood that the other pair of edge pieces *g* and *i* are provided with the same kind of guides.

The upright edge components such as shown at *d, e, e*1 and *f* are provided with guide rods 40 connected to the upright edge components and projecting inwardly for cooperation with the tubular guide sleeves 41 which are mounted by means of brackets 42 projecting from the framing 30.

From the foregoing it will be seen that the guide rods and cooperating sleeves are provided for all of the inside wall components except for the upper corner pieces identified in Figure one by the letters *k, l, m* and *n*. Thus, guiding components for all of the internal mold parts (except for the upper corner pieces) are mounted upon the framing 30. The upper corner pieces are mounted by other mechanism, preferably including for each corner piece a supporting rod such as shown in FIGS. 1B, 3, 6, 7 and 20 to 30 at 43—43 and 44—44. Each one of these rods is mounted by mechanism to be described just below, but before considering that mechanism it is pointed out that the various internal mold components can if desired be advanced and withdrawn with respect to the molding position more or less manually and independently of each other, although it is preferable to provide mechanisms which will pre-establish a sequence of motions of various of the mold components. Such mechanisms for pre-establishing a sequence of motions is shown in the drawings and is in fact associated with the mounting or supporting rods 43 and 44 for the upper corner pieces *k, l, m* and *n*, and also with certain additional rods 61—61 and 62—62, appearing in FIGS. 6, 7, 31 and 32.

From FIGS. 3, 6 and 7 it will be seen that each of the rods 43 and 44 is positioned so as to extend diagonally, downwardly and inwardly toward the central region of the structure from an upper corner of the assembled mold components, and each of these rods is mounted by suitable fixed guides or supports providing for axial reciprocation toward and away from the inside corner, carrying with it the corner piece *k, l, m* or *n*, carried thereby. Each of the reciprocating rods 43 and 44 is extended in a direction forming an angle of 45° to the top wall *c* and to the two side walls of the internal mold parts adjacent to one of the upper corners of the internal mold structure. Each of the rods 43 and 44 is also mounted by means of guide sleeves 43*a* or 44*a*, for reciprocating motion axially of the rod and thus in a path extended at an angle of 45° to the top wall and to the two side walls adjacent to the corner in which the rod is positioned.

The reciprocating movements of the rods 43 and 44 is effected by mechanisms such as shown in FIGS. 3 and 6–11 inclusive. For this purpose, the main base frame 29 and the internal framing 30 serve to mount a vertical, tubular guide sleeve 45 in which a vertical movable actuating rod 46 is arranged. This rod may be vertically reciprocated in any desired manner, for instance by a horizontally movable wedge assembly 47 actuable by a horizontally arranged hydraulic jack 48 (FIG. 8). The wedge assembly extends through a transverse aperture 49 in the vertical sleeve 45, and also through an aperture 50 in the central vertical guide rod 46 within the sleeve 45, so that horizontal motion of the wedge assembly will produce upward or downward motion of the actuating rod 46.

A pair of mounting brackets 51 project from the fixed vertical guide sleeve 45 and serve as mounting brackets for bell cranks 52, the inner ends of which are slotted to receive pin 53 which projects through vertically elongated slots in the guide tube 45 and which is connected with the reciprocating rod 46, so that vertical motion of the rod oscillates the bell cranks 52. As seen in FIG. 6 the outer ends of the bell cranks 52 are provided with slots which cooperate with pins 54 secured to and projecting from the two rods 43—43 which are associated with the upper corner pieces *k* and *n*. In this way vertically upward motion of the rod 46 produces downward or release motion of the rods 43—43, and downward motion of the rod 46 produces outward and upward motion of the rods 43—43.

The other pair of rods 44—44 (see particularly FIG. 7) are caused to reciprocate by means of bell cranks 55 which are mounted upon brackets 56, projecting upwardly from the main frame structure 29. The inner ends of the bell cranks 55 are provided with slots cooperating with pins 57 which are carried by the ears 58 which project through vertical slots 59 and which are fastened to the vertically reciprocating actuating rod 46. The outer ends of the bell cranks 55 are provided with slots cooperating with pins 60 which are carried by ears projecting from the rods 44. These bell cranks thus provide for reciprocation of the rods 44 when the actuating rod 46 is moved vertically, in the same general manner as described above in connection with the rods 43.

From the foregoing it will be seen that vertical motion of the actuating rod 46 causes all four of the rods 43—43 and 44—44 to move outwardly or inwardly. In addition this vertical motion of the actuating rod 46 is also utilized to effect motion of additional rods employed for positioning some of the internal mold parts and which are shown in FIGS. 6 and 7, namely the pair of rods 61—61 (FIG. 6) and the pair of rods 62—62 (FIG. 7). These four rods project upwardly and inwardly from the lower four corners of the assembly of internal mold components, and outer lower extremities and these rods are positioned to seat in the lower ends of the upright corner pieces such as shown at *d, e, e*1 and *f*, adjacent to the upper surface of the main frame structure 29.

As with the rods 43—43 and 44—44, the rods 61—61 and 62—62 are provided with suitable supporting and guiding mechanisms mounted, for example, upon brackets 61*a*—61*a* and 62*a*—62*a* projecting upwardly from the main frame 29.

The brackets 61*a*—61*a* (FIG. 6) also serve to mount bell cranks 63—63, the ends of which are slotted to cooperate with pins which serve to interconnect the rods 61 with the rods 43 and thus synchronize the motion of those rods. Similarly, the brackets 62*a*—62*a* (FIG. 7) serve to support bell cranks 64—64 which interconnect the rods 62—62 with the rods 44—44 for the same parts.

MECHANISM FOR ESTABLISHING SEQUENTIAL MOVEMENT OF INTERNAL MOLD PARTS

In addition to serving to mount the corner pieces *k, l, m* and *n*, the rods 43—43 and 44—44, together with the rods 61—61 and 62—62, also serve another important function in the equipment illustrated, i.e. these various rods are employed to impart the desired "release" motion of the other internal mold parts, as well as the motion of the various mold parts from the release position to molding position.

The actuating or operating mechanisms which are associated with the rods 43—43, 44—44, 61—61 and 62—62 are arranged to establish a predetermined sequence of motions of the various internal mold components both in the outward movement or in the inward or releasing movement of the components.

The mechanism providing for the motions and for establishing the sequence of motions of the mold parts includes elements which are mounted on the rods themselves and which cooperate with elements connected with the internal mold components. The cooperating elements referred to are in the nature of and are herein referred to as cam and cam follower elements, or as cams and cam followers. This mechanism is particularly illustrated in FIGS. 20 to 33 inclusive in which the parts are shown in various different positions in order to illustrate the sequence of motions of the mold components. Before considering the illustrations in FIGS. 20 to 33 inclusive, it is first pointed out in general that the sequence of motions of the molding components contemplated according to the present invention during withdrawal or retraction of the molding components is given in the tabulation just below. Each of the numbered positions represents a position of retraction of the components from position #0, which is used to identify the position which the parts occupy during the molding operation.

#1. The upper corner components *k, l, m* and *n* are first retracted;

#2. Two opposite upper edge components (for instance *g* and *i*) are retracted;

#3. The other two opposite upper edge components *h* and *j* are retracted;

#4. All four of the upright edge components shown at *d, e, e*1 and *f* are retracted;

#5. All of the side wall sheets such as those shown at *a, a*1, *b* and *b*1, and also the top wall sheet *c* are retracted.

In FIGS. 20 to 29, 31 and 32, the positions of the mechanism are identified by the numbers given to the foregoing listing of the sequence of operations, and in addition, another marking identified as #0 is also applied, indicating the fully extended position of all of the molding components, i.e. the position representing the molding position of the components.

With regard to these motions and the sequence thereof it is pointed out that because of the sequence it is necessary, or at least highly desirable to provide bevelled interengaging edges (preferably at 45° bevel) between the various mold components, and these bevelled edges are shown in the series of views of FIGS. 20–32 inclusive. The bevelling of the edges not only permits the sequence of motions to occur, but in addition the bevelling of the edges assures that when the components are all advanced outwardly into molding position, the seams or joints between adjacent edges of the components do not present slots of any appreciable width, which would be objectionable in the molding of the module, because this would result in the molding of "flash" or ridges on the inside surface of the module being formed.

The bevelling of certain of the edges of one of the corner pieces *m* also appears in FIG. 1B. As to the corner pieces, it will be seen that each one of them comprises three of the six side walls of a cube. The free edges of these walls, i.e., the six edges lying adjacent to the ends of the angle pieces which form the adjoining horizontal and vertical edge components, are all bevelled, preferably at a 45° angle. The bevel is located on the outer side of each of those six edges, so that when the corner pieces are drawn inwardly away from the molding position, in the manner fully explained hereinafter, the 45° edge bevelling will avoid interference with the adjoining ends of the channel pieces which form the edge components. Those adjoining ends of the edge components are provided with complimentary 45° bevels, as will be seen.

Similar bevelling is employed on the adjoining edges of the wall and ceiling sheets such as those indicated at *a, b, c*, etc., and the adjacent edge components, such as indicated at *d, e, f, g, h, i*, etc., these bevels being oriented to permit the inward withdrawal of the edge components without interference with the adjacent edges of the wall and ceiling sheets.

The 45° bevelling of the various edges referred to clearly appears in the sequence of views of FIGS. 20 to 32 inclusive and it is noted that the 45° bevelling is of course related to the 45° angular motion of the operating rods 43—43, 44—44, 61—61 and 62—62 (see also FIGS. 6 and 7), and also to the arrangement of the guiding rods (shown in FIGS. 4 and 5) such as the rods 38 and 40, which are arranged to provide for inward withdrawal motion of various of the edge components in a direction at 45° to the planes of the adjoining side or top wall molding sheets.

Before considering the various parts particularly illustrated in the sequence of views of FIGS. 20 to 32, the following general identification of those figures should be noted:

FIG. 20 — Plan view of one corner of internal mold parts with top plate *c* broken away to disclose a portion of operating rod 44 and associated cam and cam follower elements, with the parts in position #0, i.e. with the molding components in molding position.

FIG. 21 — Plan view of same corner as in FIG. 20, but with parts in position #5, i.e. with the molding components in the fully retracted position.

FIG. 22 — Plan view of same corner as in FIG. 20, but with parts in position #1, i.e. with the corner component *n* retracted.

FIG. 23 — As FIG. 22 but further illustrating the point of engagement of the cam with the cam follower provided for retracting the upper edge component *i*.

FIG. 24 — Plan view of same corner as in FIG. 20, but with parts in position #2, i.e. the position in which the two upper edge components *g* and *i* have been retracted.

FIG. 25 — As FIG. 24, but further illustrating the point of engagement of the cam with the cam follower provided for retracting the upper edge component *h*.

FIG. 26 — Plan view of same corner as in FIG. 20, but with parts in position #3, i.e. the position in which the two pairs of upper edge components *g* and *i*, and *h* and *j*, have been retracted.

FIG. 27 — Plan view of the same corner as in FIG. 20, but with certain additional parts omitted in order to disclose other cam and cam follower elements, with the parts in position #0, i.e. with the molding components in molding position.

FIG. 28 — Plan view of same corner as in FIG. 27, but with parts in position #4, and illustrating the point of engagement of the cams and cam followers for commencement of the retraction of the side wall components, two of which are indicated at *a*1 and *b*.

FIG. 29 — Sectional elevational taken as indicated by line 29—29 on FIG. 21 and showing parts in position #5, i.e. in position with all of the side wall sheets *a*, *a*1, *b* and *b*1, as well as the top wall sheet *c* retracted, this view also illustrating in dot-dash lines the point of engagement of the cam with the cam follower provided for retraction of the vertical edge component *f*.

FIG. 30 — Sectional view taken as indicated by line 30—30 in FIG. 29 and showing the orientation of all of the cam and cam follower elements around the axis of the rod 44.

FIG. 31 — Plan view of operating parts associated with the operating rod 61 in the lower corner of the mold structure below the parts shown in FIG. 20, the parts being shown in position #0, i.e. with the molding components in molding position.

FIG. 32 — Sectional elevational taken on line 32—32 on FIG. 31 and also showing the parts in position #0.

It will be understood that all four upper corners are of the same construction and that all four of the lower corners are also of the same construction.

Before considering various of the cam and cam follower elements in detail, it is first pointed out that the elements employed in association with each one of the mold components have certain characteristics in common. Indeed, the cam and cam follower parts providing for the motion of each mold component function in exactly the same manner, although the movement of the mold component does not occur in the same relation to the movement of the associated diagonal operating rod 43 or 44 or 61 or 62. Because of the illustration in FIGS. 20 and 21 of most of the operating elements, and because of the omission from FIG. 29 of most of the operating elements, the following description is first directed to the structure shown in FIG. 29, from which the action is most clearly evident.

First note that as shown in FIG. 29, the operating rod 44 carries the corner piece *n*, which corner piece when the parts are in position #0 defines the corner of the internal molding surface, but which corner piece is progressively retracted inwardly by the motion of the operating rod in the direction indicated by the arrow, until the fully retracted position #5 is reached. Here it will be seen that the corner piece *n* is shown in section, but in full lines. Intermediate positioning of the corner piece appear in dot-dash lines in FIG. 29.

It will further be seen in FIG. 29 that the upright edge component *f* is provided with a cam follower 74 (see also FIG. 30) which is slotted to receive the cam element 75, and from FIG. 29 it will be seen that the edge component *f* has already been withdrawn inwardly from the dot-dash line position to the position shown in full line. The slot in the cam follower 74 is of width corresponding to the maximum width of the cam element 75, in view of which, with the position of the parts shown in FIG. 29, motion of the operating rod 44 from the innermost position (position #5) outwardly toward position #0 will cause the edge component to move outwardly until the position indicated on the cam at 75*a* is reached. This position of the cam 75 with relation to the cam follower 74 is fragmentarily indicated in dot and dash line in FIG. 29.

As indicated in the note applied to FIG. 29, this point is reached at position #3, and at that time, the portion of the cam element 75 which is inclined from the point 75*a* to the point 75*b* enters the slot in the cam follower 74 so that the displacement of the component *f* is terminated and the edge component will remain in its molding position during the continued motion of the operating rod to position #0, in which the corner component *n* (and also various other internal molding components) are located in the molding position.

Upon motion of the rod 44 to retract the mold parts, the motion of the cam 75 does not influence the position of the edge component *f* until position #3 is reached, at which time the surface 75*c* of the cam engages the "bottom" of the slot in the cam follower 74, thereby initiating the inward motion of the edge component *f*.

A brace or bracket 76 is provided to interconnect the free end of the cam 75 with the rod 44.

As will be understood from FIGS. 4 and 5 and the above description, the inward motion of the vertical edge component *f* is guided as by means of guide rods 40 operating in guide sleeves 41, so that the motion of the vertical edge component is horizontally inward, rather than at the 45° angular motion of the operating rod 44.

A similar action will also be observed from FIGS. 29 and 30 in relation to the top plate *c* of the internal mold parts. Thus, the operating rod 44 carries a cam 78 which is connected to the rod and also braced as by the brace 78*b*, the cam 78 passing through a slot formed in the cam follower 79 which is connected with the top plate *c*. With the position of the parts shown in full lines in FIG. 29, the top plate *c* has been retracted downwardly and this retraction motion occurred during the motion of the operating rod from position #4 to position #5. A portion of the cam 78 in dot and dash lines in the position it would occupy in position #4 is shown in FIG. 29, and the note applied to this portion of FIG. 29 indicates the point at which the surface 78*c* would engage the bottom of the slot in the cam follower 79 and thereby commence the downward motion of the top plate *c*. Cam 78 also has an inclined surface between the points 78*d* and 78*e* for the same purpose as described above with reference to cam 75, i.e. to permit the outward motion of the operating rod 44 after point 78*d* passes through the slot in cam follower 79, from position #4 toward position #0, without continuing to displace the plate *c* beyond the normal molding position.

As will be seen from FIGS. 4 and 5, the guide rods 35 for the top plate and the cooperating sleeves 37 will assure the desired vertical motion of the top plate.

From FIG. 29 it will be noted that the width of the cams 75 and 78 is different, cam 78 being wider than cam 75. Correspondingly, the slot in the cam follower 79 for the cam 78 is wider than the slot in the cam follower 74 for the cam 75. The greater width of the cam 78 and the slot in the follower 79 results in delayed retraction of the top plate *c* during inward movement of the rod 44, as compared with the inward movement of the vertical edge component *f* which is retracted by the cam 75 cooperating with the cam follower 74. The cams and cooperating cam slots in the cam follower elements for other components are also of different width, to thereby establish the sequence of retraction motions identified above by the position numbers: #1, #2, #3, #4 and #5. This relationship of parts establishes the described sequence of inward and outward motions of the molding components.

It is also to be observed that in all instances, the inclined cam edge (for instance the inclined edge between points 75*a* and 75*b* on cam 75, or the inclined cam edge between points 78*d* and 78*e* on cam 78) extends along a line parallel to the axis of rod 44 and to the path of movement of the operating rod. This angle is 45° from the adjoining surfaces of the mold structure in the corner into which the operating rod extends.

Cam and cam follower devices of the kind described above with particular reference to FIG. 29 are utilized for the retraction of all of the molding components, except for the corner components identified in FIG. 1 by the letters *k, l, m* and *n*. As will be understood from inspection of FIG. 1, in addition to the corner component for any of the upper corners of the structure, for instance the corner component *n* which is the one shown in FIGS. 20 to 29 inclusive, there are six other components utilized in combination with the corner component *n* in order to define the molding surfaces of that particular corner of the assembly. Each one of the six additional components is provided with cam follower cooperating with a cam mounted upon the operating rod 44. The radial planes of distribution and spacing of these six cams and cam followers is illustrated in FIG. 30. First it is noted that in FIG. 30 the cams 75 and 78 which have been described above with reference to FIG. 29 are located in radial planes extended respectively below and above the operating rod 44. The vertical edge component *f* and its cam follower 74 also appear toward the bottom of FIG. 30, and the top plate *c* and its cam follower 79 appear toward the top of FIG. 30.

In FIG. 30 the cams 77*a* and the cooperating followers 77 are located in planes angularly offset by approximately 60° from the radial plane of the cam 76, one of the cams 77*a* being positioned at each side of the cam 76. The two cam followers 77 are respectively connected with upright wall plates or sheets *a*1 and *b*, which, as seen in FIG. 1, are the vertical wall components associated with this particular corner of the structure.

FIG. 30 still further illustrates cam 69 and cooperating cam follower 68, as well as cam 72 and cooperating cam follower 71 which are respectively associated with the horizontal edge strips or horizontal edge molding components *i* and *h*. Cams 69 and 72 extend from the operating rod in planes angularly offset at 60° from the radial plane of the top cam 78. Thus it will be seen that the six cams associated with the operating rod 44 are all distributed at approximately 60° intervals around the axis of the operating rod. The molding surface for this corner is completed by the corner piece or corner component which, instead of being operating through the intermediation of a cam and cam follower, is directly mounted on the outer end of the operating rod 44.

With the foregoing description in mind, attention is now directed to other views showing the sequence of motions imparted to the molding components, as seen in FIGS. 20 to 28. It will be observed that all of these figures are plan views and illustrate the same corner as shown in elevation in FIG. 29.

In FIG. 20, all of the parts which appear in that figure are illustrated in the molding position (#0), and in FIG. 21, all of the parts which appear in that figure are illustrated in the fully retracted position (#5). FIG. 20 clearly shows the cams 69 and 72, and the followers 68 and 71 provided for moving the upper edge components *i* and *h*. FIG. 22 shows certain of the parts as retracted to position #1, and this position is also illustrated in FIG. 23, which additionally shows the point at which the cam 69 commences retraction of the horizontal or upper corner com-ponent *i*.

In FIG. 24 the position of certain components is illustrated when the operating rod 44 is retracted to position #2, and the resultant retraction of the angle piece *i* is indicated. This same position is illustrated in FIG. 25, which further shows the point of commencement of retraction of the angle piece *h* by the cam 72 and the cam follower 71.

In the progression of the retraction motion, FIG. 26 illustrates position #3 in which the cam 72 and the follower 71 have retracted the horizontal edge component *h*.

FIGS. 27 and 28 particularly illustrate the cams 77*a* and the followers 77 which are connected with the sheets or wall molding components *a*1 and *b*. FIG. 27 shows these parts in fully extended or molding position #0, and FIG. 28 corresponds to position #4 in which the edge surface of each cam 77*a* comes into engagement with the end of the slot in the cooperating cam follower 77, and thus commences the inward displacement of the two upright wall components *a*1 and *b*. Movement of the parts from position #4 shown in FIG. 28 to position #5 shown in FIG. 21 effects the retraction of the side wall plates *a*1 and *b*, and this completes the retraction of all of the molding components. As is illustrated and as will be understood, the portions and positions of the cams and cam followers pre-establishes the sequence of motions of the various components as explained hereinabove. Various of the cams are also provided with braces interconnecting the free end of the cam with the operating rod 44. Thus, as shown for example in FIGS. 20 and 21, cams 69 and 72 have ties or braces 70 and 73, and as shown in FIG. 29, cams 75 and 78 have ties or braces 76 and 78*b*.

It will be understood that each of the four top corners of the internal molding components and equipment associated therewith will be constructed in the manner described above, but it is noted that the operating rods are arranged in pairs 44—44 and 43—43, as illustrated respectively in FIGS. 7 and 6.

The outward movement of the molding components to the molding positions may be limited or controlled in various ways. For example, the ties or braces such as those referred to above and some of which are identified by numerals 70, 73, 76 and 78*b* may be positioned so that they will engage the side face of the cam followers associated with their respective cams when the control rod 44 is displaced outwardly to the molding position (#0). Another form of stop mechanism is illustrated in FIG. 5*a*. This shows a modified arrangement of guide parts of the kind shown in FIGS. 4 and 5. The guide rods shown in those figures may extend through the cooperating guiding sleeves and a limiting stop may be provided at the end of the guid rod. For example, as shown in FIG. 5*a*, one of the guide rods 35 is there illustrated as extending through its guide sleeve 37*a*, the rod being provided with a abutment at its inner end indicated at 35*a*, arranged so that upon outward movement of the guide rod, the motion will be arrested by the abutment 35*a*. Such an abutment arrangement, provided on various of the guide rods, will assure accurate positioning of all of the molding components in position #0.

For the purpose of limiting the range of motion of the parts, provision may also be made for limiting the vertical motion of the rod 46 (see FIGS. 6 and 7). For instance, referring to FIG. 6, the length of the slot in the tube 45 through which the pin 53 projects may be used to determine the throw of the bell crank 52 and thus of the operating rods 43.

From the foregoing analysis, it will be seen that opposite edge surfaces of each cam come into contact with opposite ends of the slot formed in the cooperating cam follower, thereby causing motion of the connected molding component either inwardly to contact the component or outwardly to move the component into molding position. If desired, anti-friction means may be introduced at the interengagement surfaces of the cam and cam follower. For example, as illustrated in FIG. 33, which shows a portion of one of the cam followers, a roller *x* may be mounted at the end of the slot so as to ride on the adjacent edge of the cooperating cam.

Turning now to FIGS. 31 and 32, it is first noted that these figures illustrate the mold mounting and operating parts employed at one of the lower corners of the internal mold structure. As is described above, the mold structure is opened at the bottom so that each of the lower corners is formed between only three molding components, namely two upright wall sheets and one vertical edge component. FIGS. 31 and 32 illustrate the parts at the corner formed between the vertical edge component *f* and the two adjacent upright wall sheets *a*1 and *b*. As will be seen from FIG. 6, the operating rod employed at this corner is one of the two operating rods identified as 61 and that rod appears in both of FIGS. 31 and 32. Rod 61 extends downwardly and outwardly into the lower corner at an angle of 45° to the wall sheets *a*1 and *b* and also to the horizontal plane of the bottom edges of the molding structure. Three cams and cam followers are here employed, one for each of the three components making up this corner. Thus, cam followers 61*b* are connected with the wall plates *a*1 and *b* and cooperate with cams 61*c* mounted on the rod 61 and arranged in the same manner as described above, providing for retraction of the wall plates when the rod 61 moves from the #4 position to the #5 position. This corresponds to the movement timing or sequence of moving of the cam followers 77—77 and 79 for the side wall plates and the top plate, which are operated by the upper rod 44 described above. In addition, the upright edge component *f* is provided with a cam follower 61*d* cooperating with a cam 61*e*, these parts being proportioned and positioned to provide for concurrent retraction of the lower end of the vertical edge component *f* at the time when the upper end of the component *f* is retracted, as described above with particular reference to FIG. 29.

It will be noted that the cams 61*c*–61*c* and 61*e* are connected with the operating rod 61 at the free ends of the cams, but that no ties or braces are used at the free ends of the cams. The loads on these cams are not as great as those carried by the cams at the upper corners and the omission of the ties simplifies the structure and assembly.

From the foregoing it will be seen that provision is made for establishing a predetermined sequence of withdrawal of internal molding components, mechanisms being provided to effect this sequence upon the actuation of a single central actuator, such as the hydraulic cylinder 48 shown in FIG. 8. However, as above indicated, if desired, the automatic mechanism for establishing and effecting the withdrawal sequence need not necessarily be employed, and provision may be made for manual internal access to the mounting parts, so that various molding components may be withdrawn from and advanced into molding position manually instead of by the operating mechanisms described.

EXTERNAL MOLDING COMPONENTS

Turning now to the external mold parts, attention is again directed to the fact that the outside surface of each wall is defined or molded by a superimposed series of molding strips *s* (see FIGS. 12, 13 and 16). The strips for each wall are mounted in a frame comprising an external mold support frame, and with the four-sided module here shown, there are, of course, four such external mold frames. These external mold frames are indicated generally in FIG. 2 by the numeral 81, and each one of them has an outer cross piece 82 and a pair of side members or legs 83 which project toward the main frame structure 29 described above and which are connected with the main frame structure at the corners thereof by means of a post of triangular section 84, so that the posts of each joint fit together to form a square upright structure as clearly appears in FIGS. 2, 13 and 17*a*.

One of the corner joints is shown in the exploded view of FIG. 19 and from that view it will be seen that the external frame parts 83 are provided with overlapping interfitting flanges 85 provided with registering apertures through which downwardly projecting tongues 86 extend. In addition a projecting plate 87 provided on the main base frame 29 at the corner is similarly apertured to receive the downwardly projecting tongues 86 and this joint therefore provides for interconnection of and accurate interpositioning of the external mold supporting frames and the internal mold positioning structure.

The outer frame structures each also have upright structural parts providing for the mounting of a series of lead screws 88, there being a pair of such lead screws for each of the mold strips *s*. The inner end of each lead screw is journalled in the triangular upright post 84 of that frame and at the other end of each screw a bevelled gear 89 is provided, this gear meshing with a bevelled pinion 90, mounted upon the counter shaft 91. A separately operable clutch unit 88*a* is provided in the connection of each bevelled gear 89 with the lead screw 88.

As shown in FIGS. 12, 13, 14 and 15, lead screw 88 cooperates with a follower nut 92 which carries projecting flanges 93 adapted to be removably secured to plates 94. Each plate 94 is secured to one end of the transverse beam 95, so that when the plates 94 are fastened to the flanges 93, both ends of the beam 95 will be moved by a pair of lead screws cooperating with the follower nuts 92. Each beam 95 supports one of the outer wall molding strips *s*, and this assembly of parts, including the pair of lead screws provides for separate advancement of each mold strip.

Although the shaft 91 and the associated gearing for the lead screws for all of the strips provide a common source of drive, the individual pairs of lead screws are separately operable under the control of the pair of clutch units 88*a*. Shaft 91, in turn, is driven from the power shaft 96 by means of motor 97 through any suitable reduction mechanism such as indicated diagrammatically at 98.

In a molding operation it is contemplated that initially the frame structure will be assembled and the various outside wall molding strips will be positioned remotely from the molding station and that the several molding strips will be advanced sequentially, beginning with the lowermost strip. For the purpose of operating the clutch units 88*a* for each pair of lead screws 88 a common control interconnection 99 is provided (see FIG. 13), having clutch operating levers 100 located externally for convenient excess to an operator. As hereinabove indicated, it is contemplated that the portion of the walls of each module being formed as defined by the lowermost outside mold strip will be cast before advancement of the second series of mold strips. This facilitates the pouring and introduction of concrete into the mold cavity. Complete filling of the mold cavity may readily be accomplished when the total overall height of the cavity tto be filled is relatively small, and, in this way, the arrangement of the invention avoids the almost insurmountable problem of filling a thin mold cavity from the top edge of the entire wall of the module.

The employment of outside frame structures extending for a substantial distance away from the molding station is also of advantage as it provides clearance or space to accommodate concrete molding equipment, for instance as carried by an overhead conveyor which may bring the pouring equipment down into the space in front of the molding strips which having not yet been advanced to molding position.

The outside mold frame structure and the operating parts are also preferably arranged to provide for the molding of modules having side walls of different horizontal dimensions. For example, referring to FIG. 13, the transverse frame piece 82 of the outside mold frame may be formed of telescopic parts 82*a* and 82*b*. A telescopic joint 101 may also be provided in the power shaft, and a telescopic joint 102 may be provided in the clutch interconnecting tie rods 99. It will be understood that in instances where modules of different sizes are to be formed, a differently dimensioned internal mold structure will of course be provided.

Referring again to FIG. 15, as above indicated the joint between the parts 93 and 94 preferably completes a separable joint so that, at the conclusion of a casting operation of a given module, these joints may be disconnected leaving the beams 95 in place to support and position the mold strips *s*, and permitting the entire remainder of the outside frame structure and operating equipment to be removed and, if desired, taken to another molding station to initiate the molding of another module, while the first is being cured or set. If desired the upper portions of the outside mold parts may be retained in position in any desired manner after removal of the outside mold frame structure, for instance by surrounding cabling.

Upon completion of the molding and curing of any given module, and after separation of the external mold parts, and still further after withdrawal of the internal mold components, the module as a whole may simply be lifted away from the structure and then transported as a unit to the point of use.

Although not specifically illustrated, it will be understood that window and door openings may be provided wherever desired, by positioning core structures against the outer sides of the wall plates of the inside molding components, so that when the outside mold strips are brought into molding position they will abut the core structures and thus cooperate in defining the walls surrounding the door or window openings. In such operations it is also contempleted that the core structures may even comprise the actual door or window frames around the door or window openings.

I claim:

1. Apparatus for molding interior surfaces of generally cubical building modules of concrete or the like having side walls joined along generally vertical edges and having a top wall spanning the side walls, said apparatus comprising: elongate, vertical, edge-defining members against which to mold a portion of the inside of said generally vertical edges; side wall mold sheets intervening between the edge-defining members; a mold sheet spanning the side wall sheets for molding the top wall of the modules; separate means mounting the edge-defining members and the side wall and top wall mold sheets and providing for translational movement between molding positions and retracted release positions; and operating means connected with said side wall and top wall mold sheets and with said edge-defining members for advancing and retracting said sheets toward and away from molding position and for advancing and retracting said members separately from said sheets toward and away from molding position.

2. Apparatus in accordance with claim 1, and in which said operating means comprises actuating means and relatively displaceable wedge cam and cam follower elements connected with the actuating means and the sheets and edge-defining members to advance and withdraw said members and mold sheets.

3. Apparatus in accordance with claim 1, and in which said operating means is effective to withdraw said members and thereafter to withdraw said sheets.

4. Apparatus in accordance with claim 1, and in which said operating means includes shaft means reciprocable within the space inside of the mold sheets, and in which said operating means further includes linkage coupling said shaft means to said sheets and members and effective to withdraw said members and thereafter to withdraw said sheets, in accordance with the position of said shaft means in said space.

5. Apparatus for molding the interior surfaces of generally cubical building modules of concrete or the like having side walls joined along generally vertical edges and having an integrally molded roof joined to said side walls along generally horizontal edges, said apparatus comprising: elongate, horizontal and vertical edge-defining members against which to mold the inside of said horizontal and vertical edges; a plurality of pieces respectively adapted to mold the upper corners in the region of intersection of such horizontal and vertical members; mold sheets intervening between the horizontal and vertical edge-defining members and cooperating therewith and with the corner pieces to complete the molding surfaces for the inside of the roof and side walls of the cubical building modules to be molded; means mounting said sheets, members and pieces for movement between molding positions and a retracted release position; and operating means connected with said sheets, members and pieces for advancing and retracting said sheets, members and pieces toward and away from molding position.

6. Apparatus in accordance with claim 5, and in which said operating means includes mechanism effective to retract said pieces, then retract said horizontal members, then retract said vertical members, and thereafter to withdraw said mold sheets.

7. Apparatus in accordance with claim 6, and further characterized that said operating means includes shaft means reciprocable within the space inside of the mold sheets and in which said operating means further includes cam and cam follower devices coupling said shaft means to said sheets, members, and pieces and effective to withdraw the same in the mentioned sequence in accordance with the position of said shaft means in said space.

8. Apparatus in accordance with claim 7, and in which said cam and cam follower devices are effective to withdraw said pieces simultaneously, and said horizontal members sequentially in opposed pairs.

9. Apparatus for molding interior surfaces of generally cubical building modules of concrete or the like, including side walls joined along generally vertical edges, said apparatus comprising: mold parts including sheets against which to mold inside side wall surfaces of said side walls and elongate, vertical, edge-defining members, a mounting structure mounting the mold parts positioned in the space inside of the mold sheets, actuating devices mounted on said mounting structure for effecting translational movement of said sheets and members toward and away from molding position, and means for guiding the translational movement of the mold parts including interengaging guide elements connected respectively with the mold parts and said mounting structure independently of the mounting of said actuating devices on said mounting structure.

10. Apparatus for molding interior surfaces of generally cubical building modules of concrete or the like having side walls joined along generally vertical edges and having an integrally cast roof joined to said side walls along generally horizontal edges, said apparatus comprising: interior mold parts operatively associated with one another including sheets against which to cast surfaces of said side walls and roof, elongate, generally horizontal and vertical edge-defining members, and a plurality of pieces each adapted to mold an upper corner in the region of intersection of horizontal and vertical members; and means operatively associated with said mold parts for advancing and withdrawing said sheets, members, and pieces, toward and away from molding positions including rods movable toward and away from the interior upper corners between the side wall and roof sheets, the corner molding pieces being mounted on said rods, and cooperating means on the rods and sheets and edge-defining members providing for movement thereof by movement of said rods.

11. Apparatus in accordance with claim 10, and in which said cooperating means are effective to withdraw first said members, and thereafter said sheets.

12. Apparatus as defined in claim 10 and further including common means operatively associated with said rods for concurrently moving at least certain of said rods.

13. Apparatus for molding interior surfaces of generally cubical building modules of concrete or the like having walls joined along edges, said apparatus comprising: separate wall defining mold components for molding adjacent areas of inside surfaces of the module being formed; mounting mechanism for the mold components; means mounting and guiding said components on the mounting mechanism and providing for separate movement thereof between molding position and a retracted release position; and operating means connected with said components for separately advancing and retracting said components toward and away from molding position, the operating means being mounted on the mounting mechanism independently of the means for mounting and guiding the components, the operating means comprising an operating member movable in a path extended at an oblique angle to the molding surfaces of the mold components, and cam and cam follower elements interconnecting the operating member and the mold components and providing for sequential movement of mold components for adjacent areas by movement of the operating member in one direction in said path of movement thereof.

14. Apparatus as defined in claim 13 in which the cam element comprises a cam plate mounted on the operating member an in which the cam follower element comprises a slotted element connected with the component associated therewith, the cam plate being extended through the slot of said follower element and providing for movement of the component in either direction between molding position and a retracted release position upon movement of the operating member in opposite directions.

15. Apparatus for molding interior surfaces of a building module having at least two side walls and a top wall joined at right angles to each other to form a corner, the apparatus comprising two horizontal edge molding components and one vertical edge molding component extended at right angles to each other, two side wall molding components and one top wall molding component in the form of sheets lying in planes at right angles to each other and adjoining the edge molding components, means mounting at least a plurality of said components for separate movement between the molding positions thereof and retracted mold release positions, and mechanism connected with a plurality of said components for effecting retraction of a plurality of said components comprising a movable operating member and cam and cooperating cam follower elements interconnecting the operating member and components to be retracted and providing for sequential retraction of the components upon movement of the operating member in one direction.

16. Apparatus for molding interior surfaces of a building module having at least two side walls and a top wall joined at right angles to each other to form a corner, the apparatus comprising a corner molding component, two horizontal edge molding components and one vertical edge molding component extended from the corner component with the edge molding components at right angles to each other, two side wall molding components and one top wall molding component in the form of sheets lying in planes at right angles to each other and adjoining the edge molding components, and mechanism for moving said components between molding positions thereof and retracted mold release positions including means mounting at least a plurality of said components for separate movement between the molding positions thereof and retracted mold release positions.

17. Apparatus as defined in claim 16 wherein said mechanism including means for effecting sequential retraction of at least certain of the molding components.

18. Apparatus as defined in claim 17 in which said mechanism comprises a reciprocable operating member and cam and cam follower elements interconnecting the operating member and molding components.

19. Apparatus as defined in claim 18 in which the operating member is reciprocable along an axis extended into the interior of the corner component, the corner component being mounted on said reciprocable member and being movable between molding and release positions by reciprocation of said member.

* * * * *